US011648791B2

(12) United States Patent
Smith et al.

(10) Patent No.: US 11,648,791 B2
(45) **Date of Patent: *May 16, 2023**

(54) DIE CUT CALENDAR

(71) Applicant: The Lang Companies, Inc., Waukesha, WI (US)

(72) Inventors: Julie Smith, Summit, WI (US); Kathy Paider, West Allis, WI (US); Kelli Melzer, Brookfield, WI (US); Michelle Kesler, Waukehsa, WI (US)

(73) Assignee: The Lang Companies, Inc., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/362,061

(22) Filed: Jun. 29, 2021

(65) Prior Publication Data

US 2021/0323336 A1 Oct. 21, 2021

Related U.S. Application Data

(63) Continuation-in-part of application No. 16/913,778, filed on Jun. 26, 2020, now Pat. No. 11,059,315.

(60) Provisional application No. 62/866,770, filed on Jun. 26, 2019.

(51) Int. Cl.

| | |
|---|---|
| ***B42D 5/04*** | (2006.01) |
| ***B42D 15/00*** | (2006.01) |
| ***B42D 5/00*** | (2006.01) |

(52) U.S. Cl.

CPC ..... *B42D 5/041* (2013.01); *B42D 5/001* (2013.01); *B42D 15/0073* (2013.01)

(58) Field of Classification Search

CPC ..... B42D 15/0073; B42D 15/0086; B42D 5/041; B42D 5/047; B42D 1/005; B42D 1/009; B42D 1/003; B42D 1/004

See application file for complete search history.

(56) References Cited

U.S. PATENT DOCUMENTS

| | | | | | |
|---|---|---|---|---|---|
| 259,950 | A | * | 6/1882 | Hoevenbergh | G02B 27/06 281/38 |
| 1,028,921 | A | * | 6/1912 | Wagner | B42D 15/00 446/147 |
| 1,640,246 | A | | 8/1927 | Murray | |
| D157,472 | S | | 2/1950 | Drazan | |
| 2,574,899 | A | * | 11/1951 | Waring | B42D 5/041 40/119 |
| 2,582,355 | A | * | 1/1952 | Ratner | B42D 15/0073 40/107 |
| 4,178,019 | A | | 12/1979 | Gedzelman | |
| 4,228,604 | A | | 10/1980 | Cherian | |
| 5,031,935 | A | * | 7/1991 | D'Andrea | B42D 1/004 281/38 |
| D423,570 | S | | 4/2000 | Moyal | |

(Continued)

*Primary Examiner* — Gary C Hoge

(74) *Attorney, Agent, or Firm* — Boyle Fredrickson, S.C.

(57) ABSTRACT

A calendar has one or more individual pages of the calendar that include portions of the pages that are omitted, removed or removable in order to enable aligned portions of other pages of the calendar to be viewed through the removed portions. The removed portions can be formed as apertures in the page and/or as removed portions of one or more edges of the page, among others to allow the stacked pages to form a coordinated, and optionally customizable, decorative appearance for the calendar.

5 Claims, 36 Drawing Sheets

(56) References Cited

U.S. PATENT DOCUMENTS

| | | | | |
|---|---|---|---|---|
| 6,364,560 | B1 * | 4/2002 | Lin | B42D 1/003 281/38 |
| 6,508,488 | B1 * | 1/2003 | Becker | B42D 1/003 434/269 |
| 2003/0214128 | A1 * | 11/2003 | Roberts | B42D 1/00 281/31 |
| 2008/0191459 | A1 * | 8/2008 | Schultz | B42F 21/12 281/15.1 |
| 2010/0176582 | A1 * | 7/2010 | Becker | G09B 19/00 281/38 |
| 2012/0217735 | A1 * | 8/2012 | Stephens | B42F 21/12 281/38 |
| 2012/0264088 | A1 * | 10/2012 | Livne | G09B 19/00 434/100 |
| 2014/0313186 | A1 * | 10/2014 | Fahrer | G09B 5/02 345/418 |
| 2018/0215186 | A1 * | 8/2018 | Hudachek | G09F 13/00 |

* cited by examiner

DIE CUT CALENDAR

CROSS-REFERENCE TO RELATED APPLICATIONS

This application claims priority as a continuation-in-part of U.S. Non-Provisional application Ser. No. 16/913,778, filed on Jun. 26, 2020, which in turn claims priority from U.S. Provisional Patent Application Ser. No. 62/866,770, filed on Jun. 26, 2019, the entirety of which are each hereby expressly incorporated by reference for all purposes.

FIELD OF THE DISCLOSURE

The present disclosure relates generally to calendars, and more specifically to calendars including portions that are selectively viewable as consecutive pages of the calendar are turned.

BACKGROUND OF THE DISCLOSURE

Calendars, and in particular wall calendars, are often constructed with a number of individual pages secured to one another such that the individual pages can be turned to expose each individual page as desired. The individual pages are each printed or otherwise adorned with indicia regarding the particular month represented by the page and any other decorative material desired.

While many calendars are currently made that include indicia printed or otherwise disposed on the various pages of the calendar that correspond to indicia on other pages, it is necessary to completely expose and view the individual pages in order to see the indicia printed on the different pages.

As such, it is desirable to develop a calendar that includes pages that enable the viewing of indicia or other printed material on successive or other partially covered pages of the calendar that addresses and overcome the shortcomings of the prior art.

SUMMARY OF THE DISCLOSURE

According to one aspect of an exemplary embodiment of the disclosure, an improved calendar is provided in which one or more individual pages of the calendar include portions of the pages that are removed, removable or omitted during formation of the pages in order to enable aligned portions of other pages of the calendar to be viewed through the removed or omitted portions. The removed or omitted portions can be formed as apertures in the page or as removed or selectively removed portions of one or more edges of the individual pages, among others.

According to another aspect of an exemplary embodiment of the disclosure, the page(S) it the removed portion(s) can include indicia or other decorative material thereon that corresponds to material printed on one or more other pages in order for the material on the page including the removed portion and the other pages viewable through the removed portion to allow the collective pages to provide a cohesive design to an individual viewing the calendar.

Numerous additional aspects, features and advantages of the present disclosure will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Figure 1A:
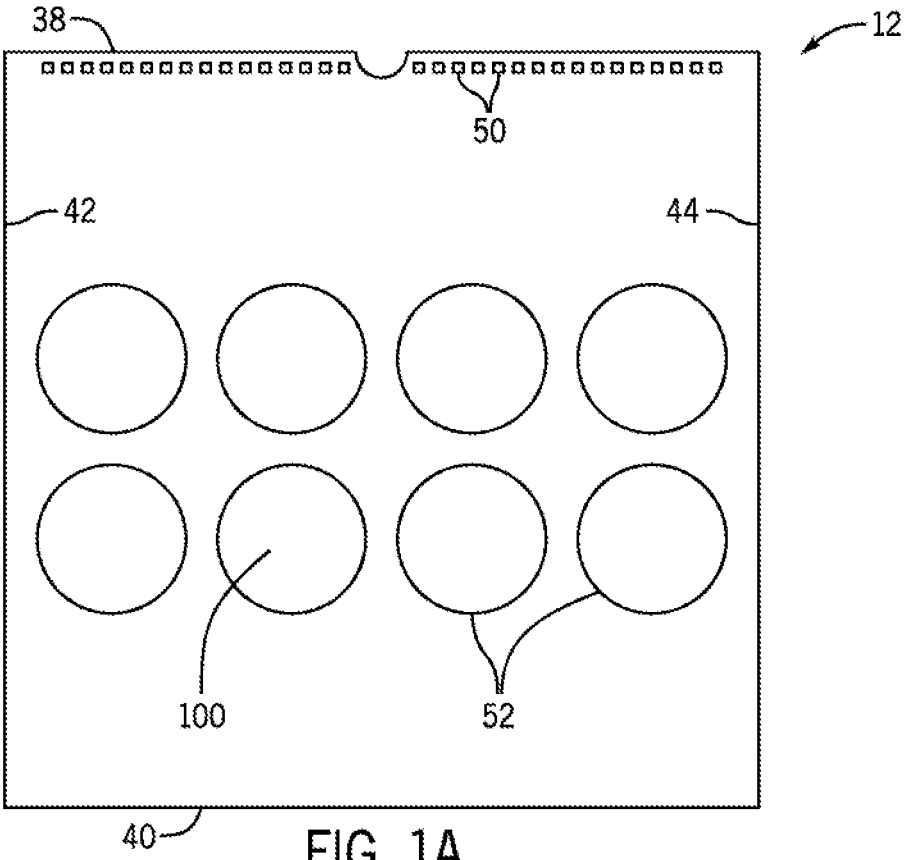
FIGS. 1A-1M are schematic views of a first exemplary embodiment of a calendar formed according to the present disclosure.
Figure 1B:
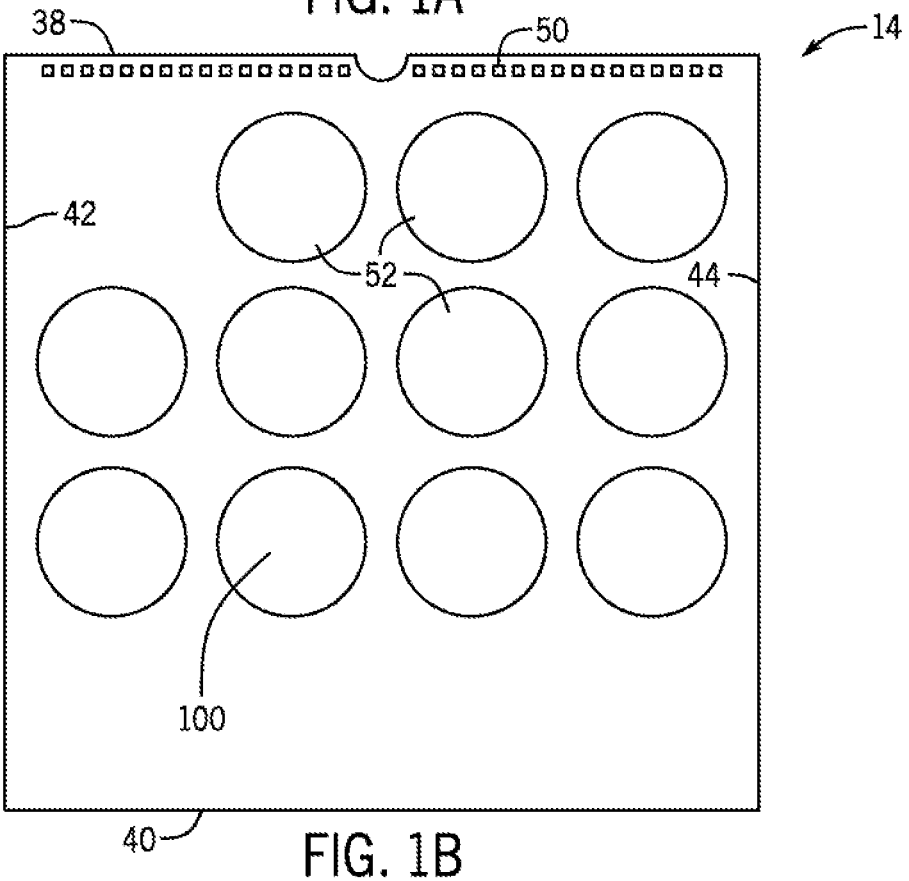
Figure 1C:
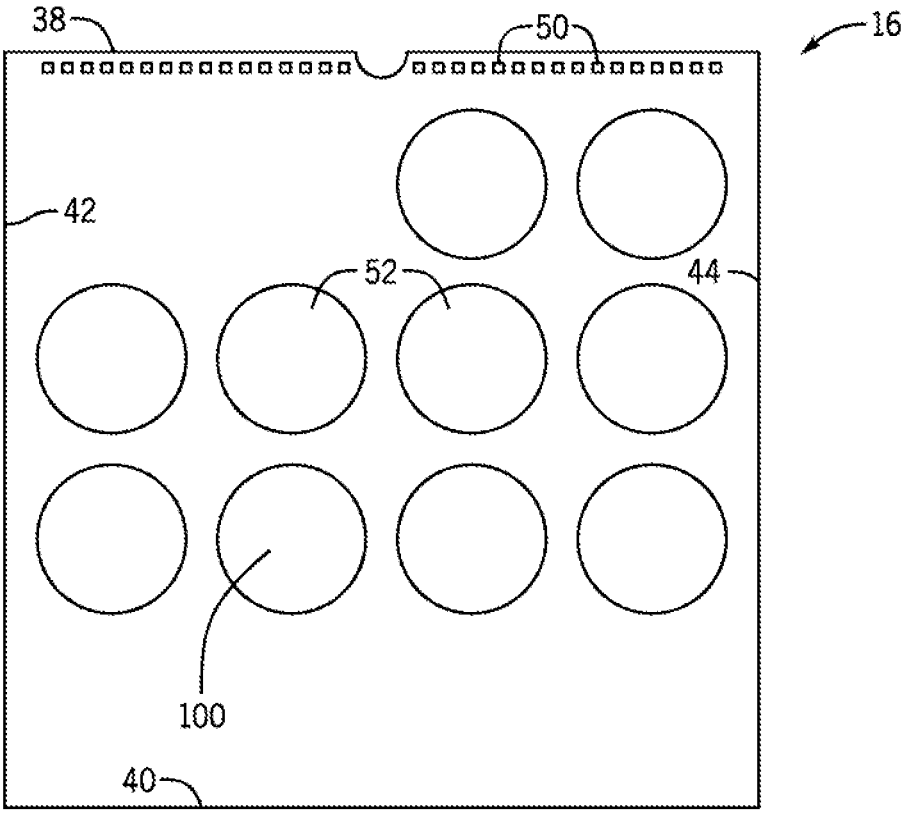
Figure 1D:
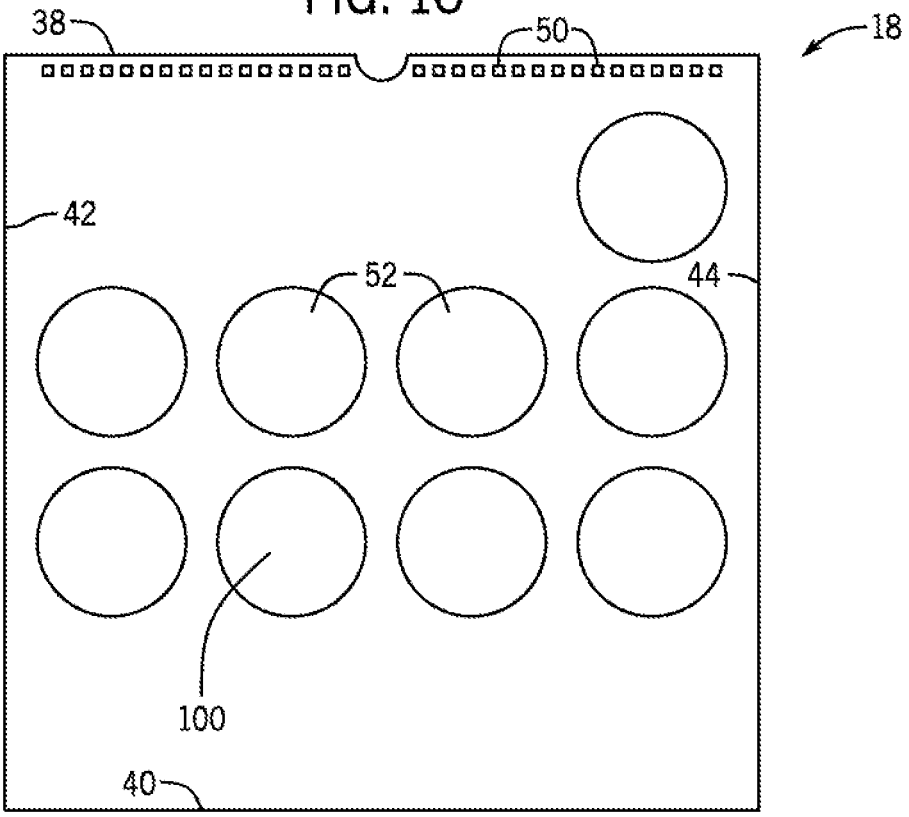
Figure 1E:
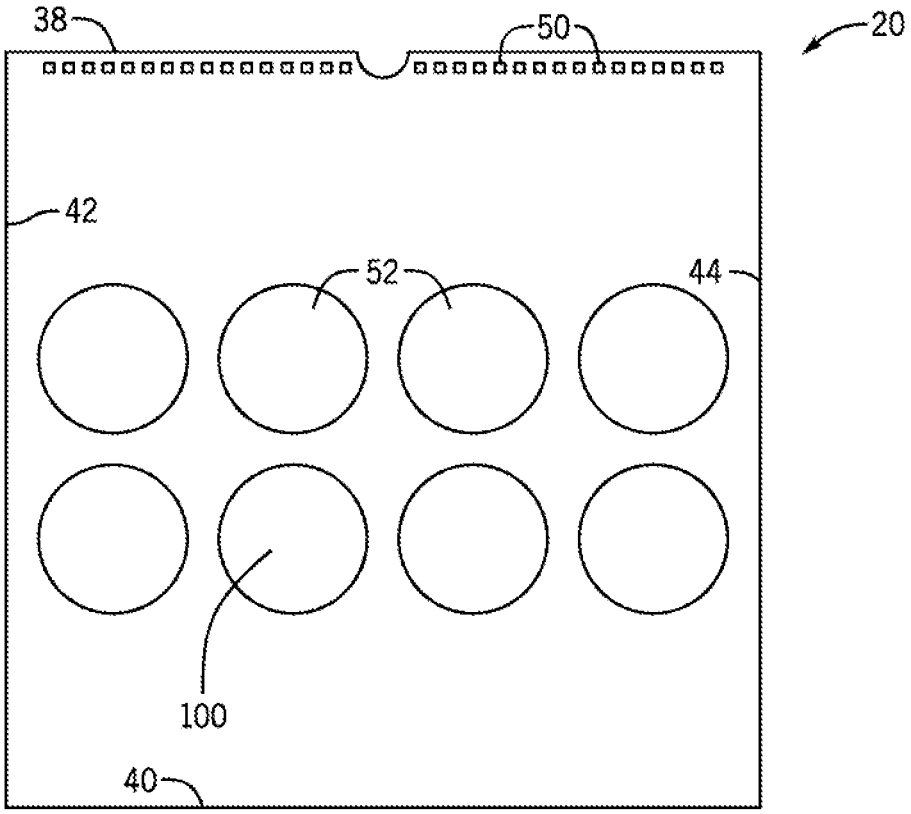
Figure 1F:
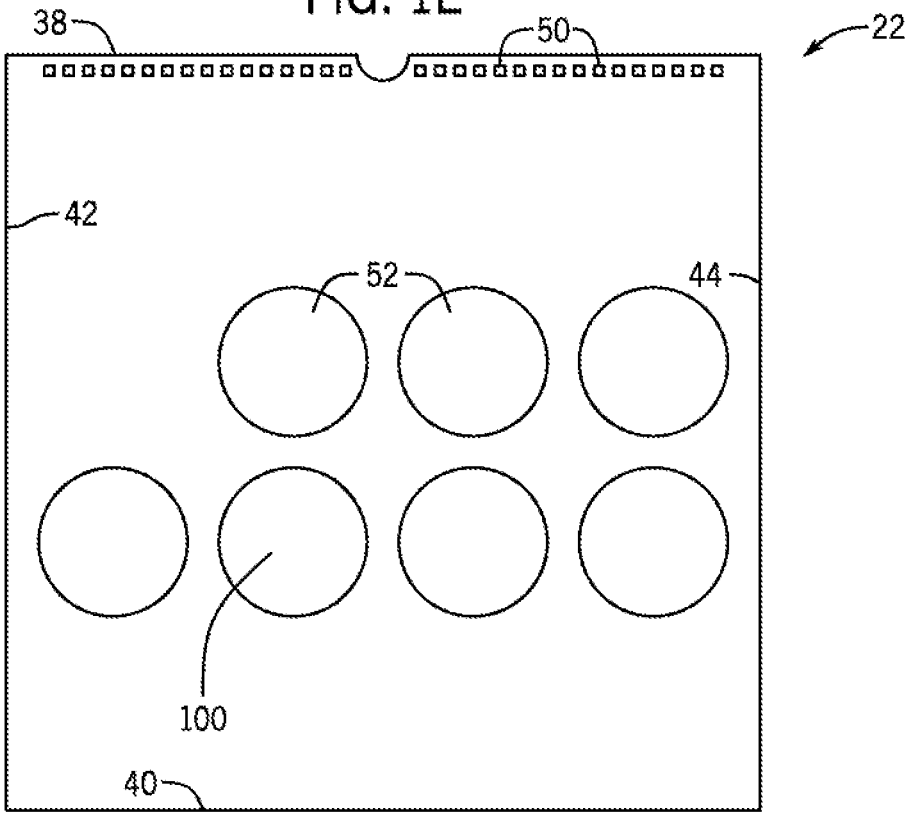
Figure 1G:
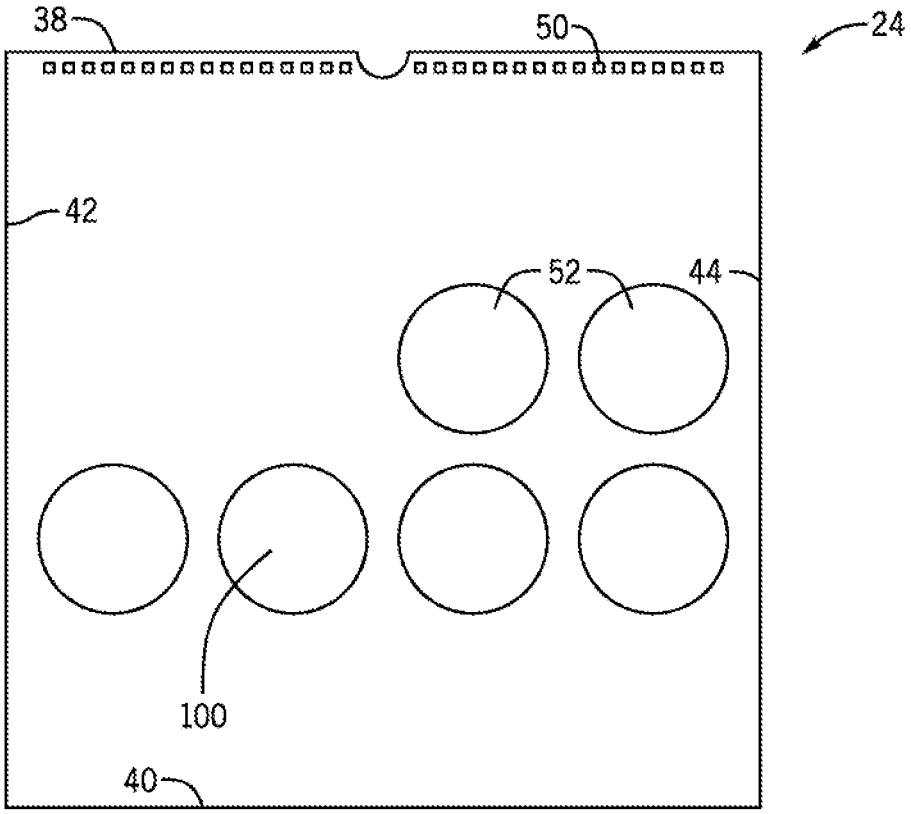
Figure 1H:
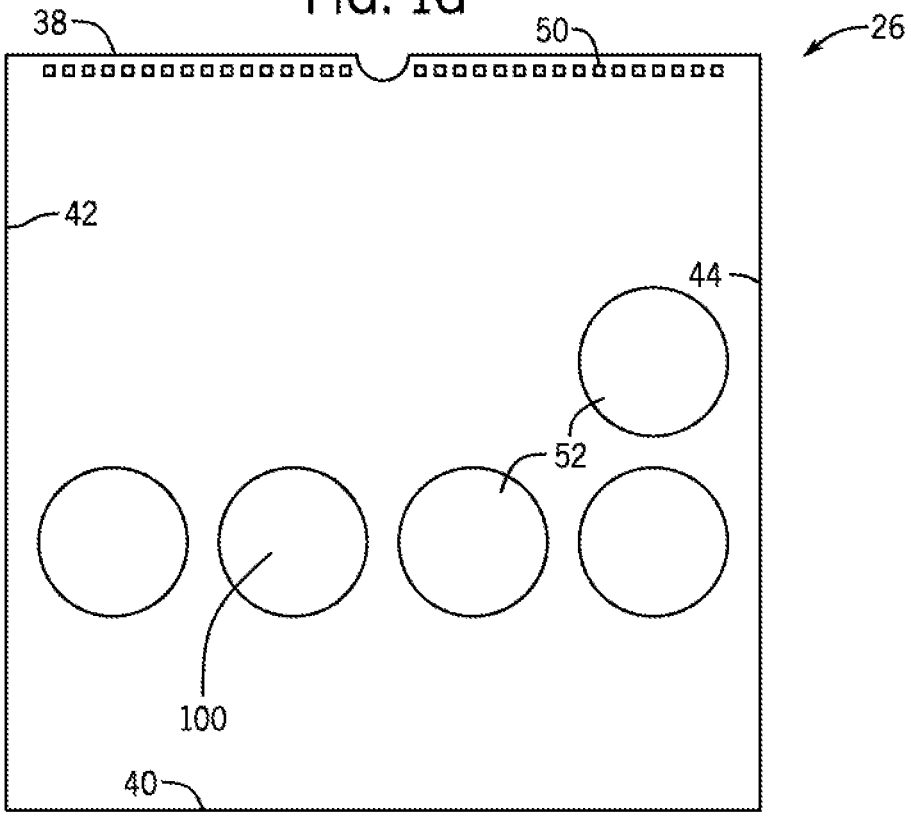
Figure 1I:
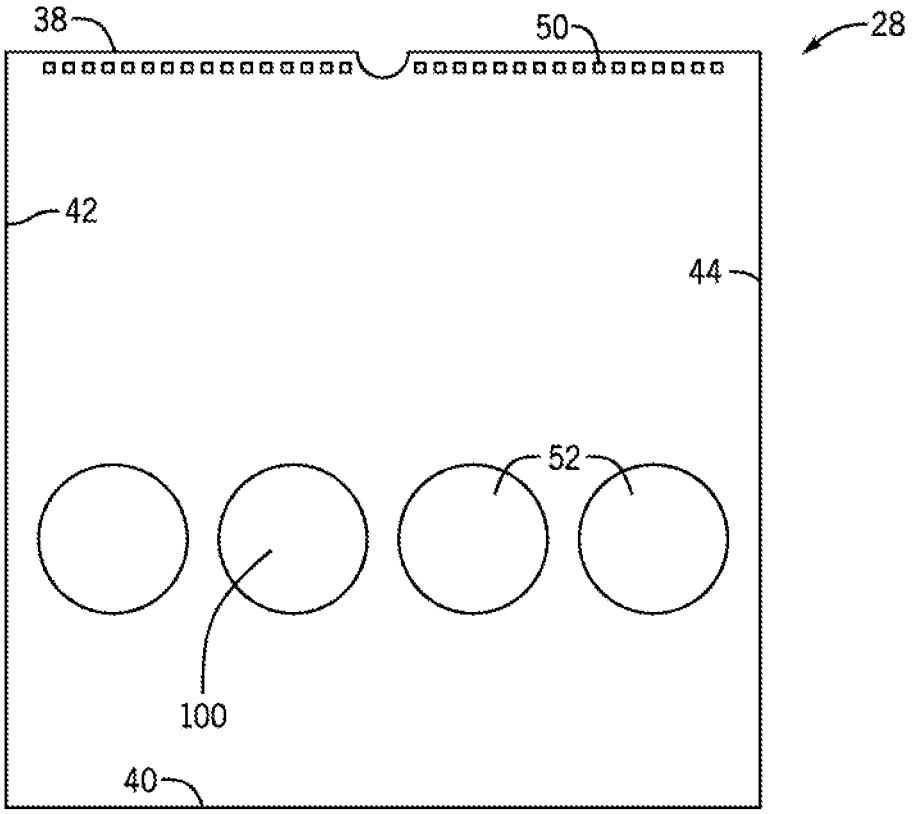
Figure 1J:
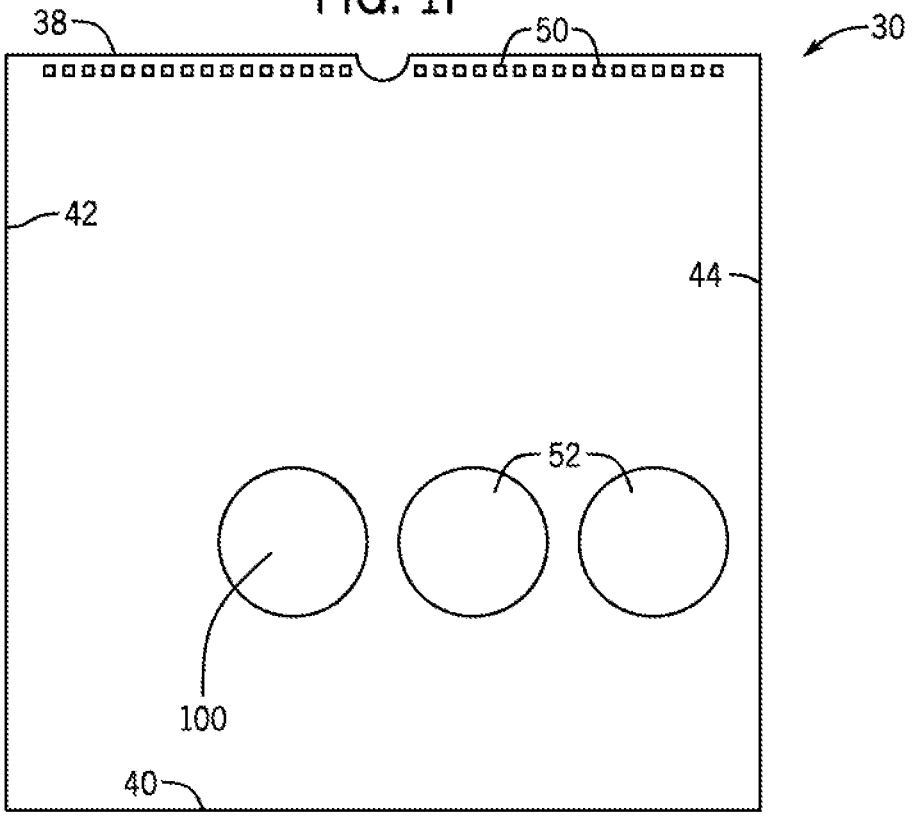
Figure 1K:
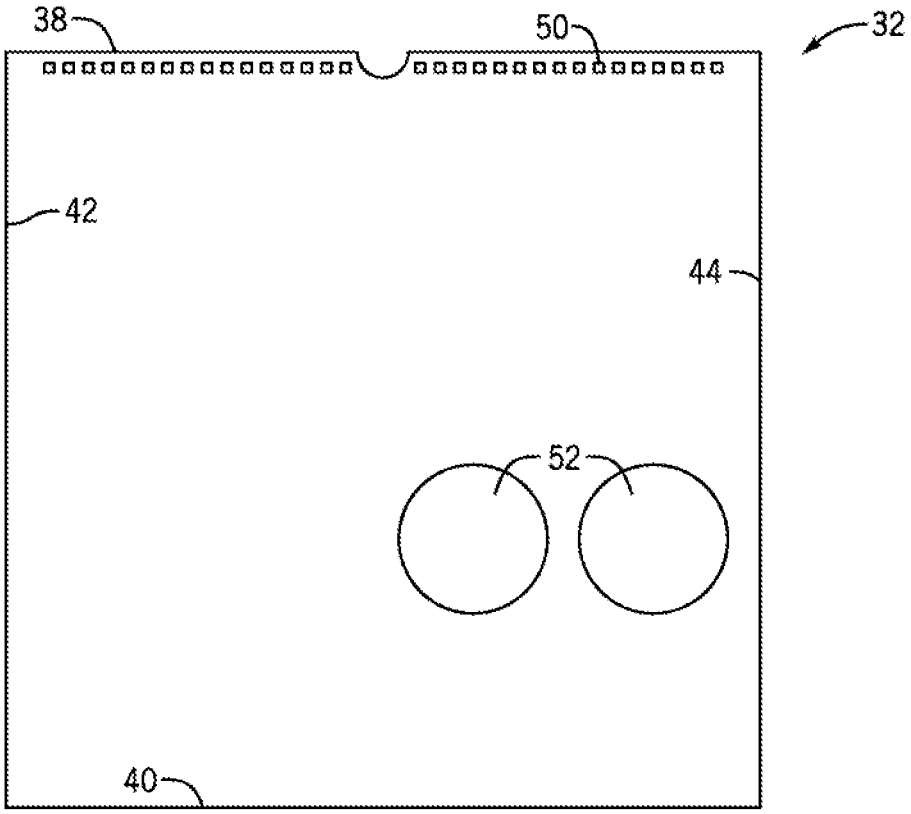
Figure 1L:
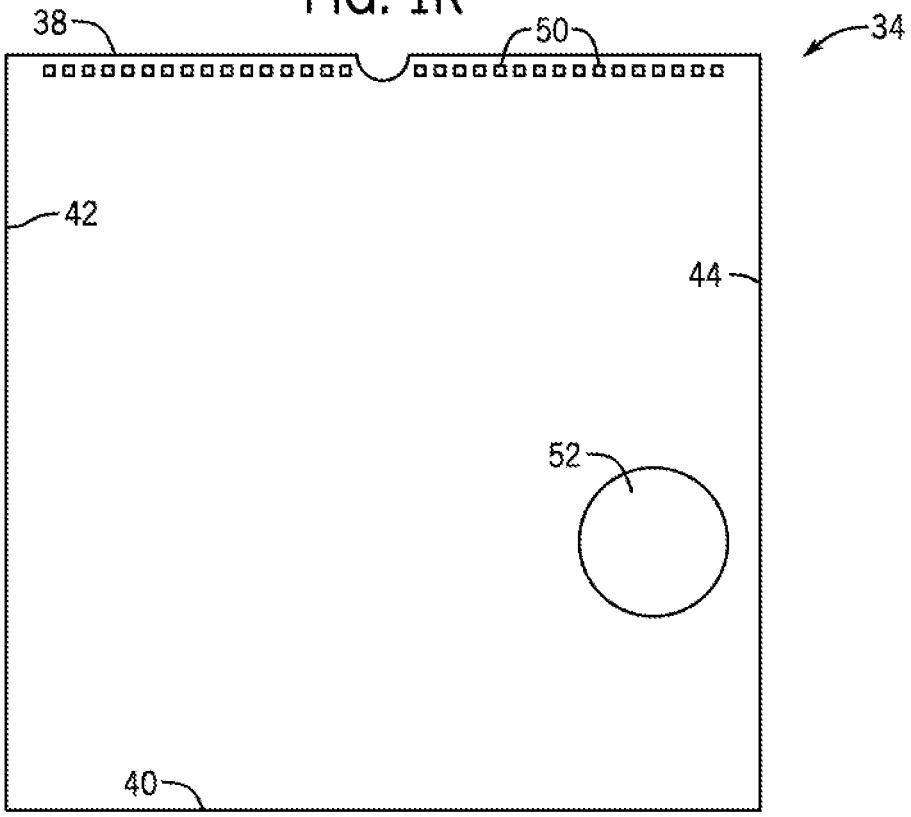
Figure 1M:
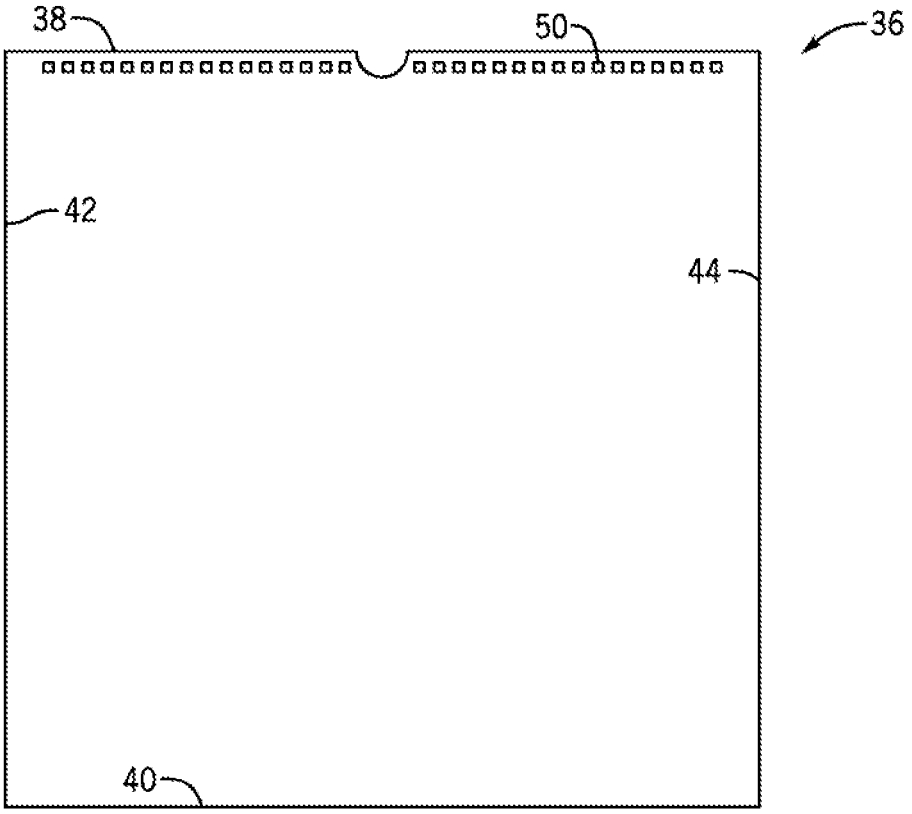

With reference now to the drawing figures in which like reference numerals designate like parts throughout the disclosure, FIGS. 1A-1M schematically represent each of the thirteen (13) individual pages 12-36 of a calendar 10 constructed in accordance with the present disclosure. Each page 12-36 includes a top edge 38, and bottom edge 40 and a pair of opposed side edges 42,44 joining the top edge 38 and bottom edge 40. The top edge 38 of each page 12-36 is attached to a securing device 46 (FIG. 2) that holds the pages 12-36 together in a moveable manner to enable each individual page 12-36 to be selectively positioned in front of the remainder of the pages 12-36. One example of the securing device 46 is a spiral coil 48 that is threaded through a number of holes 50 formed adjacent the top edge 38 of each page 12-36.

As shown in the exemplary embodiment of FIGS. 1A-1M the individual pages 12-36 also each include a number of apertures 52 formed therein. The number of apertures 52 varies in each page 12-36, from no or zero (0) apertures 52 in page 36 to twelve (12) apertures 52 present in page 14. While the number of apertures 52 is different in the various pages 12-36, the alignment of the apertures 52 in each pages 12-36, with the exception of page 36 which has zero (0) apertures 52, is consistent across all of the pages 12-34. With this consistent orientation or alignment, the apertures 52 in each page 12-34 enable an individual to view exposed areas 54 of pages 12-34 other than the topmost page 12-34 through the aligned apertures 52, in this manner, indicia 56 printed in the exposed areas 54 on each pages 12-34 can be viewed directly through the apertures 52 allowing the indicia 56 in the exposed areas 54 to coordinate with the indicia 56 on the topmost page 12-36 to form a coordinated and three-dimensional decorative image for the calendar 10.

Figure 2:
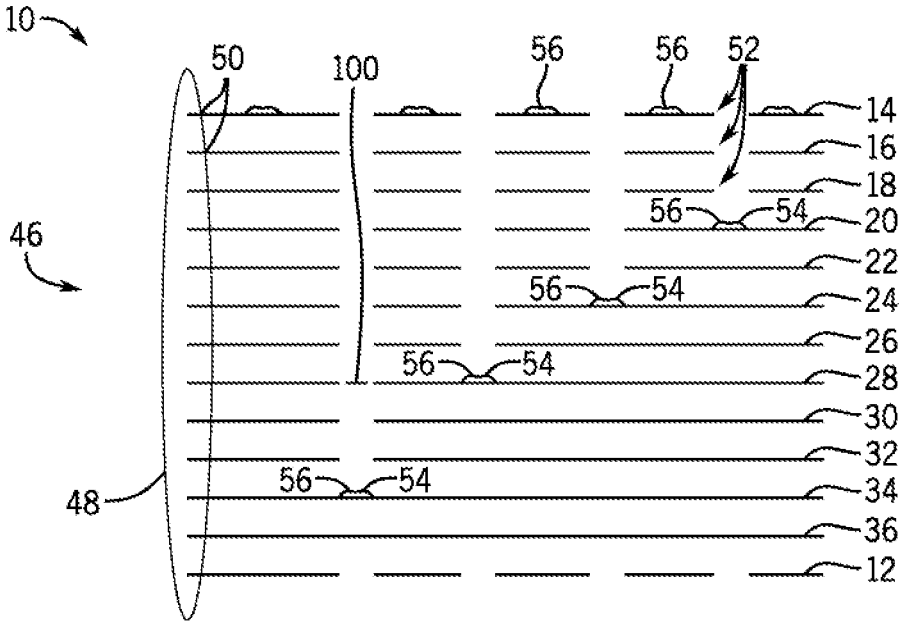
FIG. 2 is cross-sectional view of the calendar of FIGS. 1A-1M.

In the exemplary embodiment of FIG. 2, the calendar 10 is shown where the topmost page 14 includes apertures in alignment with apertures 52 in pages 16-32 in order to enable the indicia 56 on pages 20, 24, 28 and 34 to be viewed along with the indicia 56 on page 14. Moving the pages 12-36 with respect to one another using the securing device 46 selectively positions a page 12-36 in the topmost position and will alter the alignment of the apertures 52 to provide a different coordinated image using the indicia 56 on the exposed areas 54 or the pages not having apertures 52 in alignment with the topmost page 12-36, unless pages 12-36 are located beneath a page 36 not having any apertures 52.

Alternatively, the apertures 52 can initially be formed as removable, e.g, perforated sections 100 of the pages 12-36. The perforated sections 100 can be selectively removed in order to customize the overall coordinated image provided by the indicia 56 located on each of the pages 12-36. Further, the pages 12-36 can include combinations of apertures 52 formed as complete apertures 52 to the pages 12-36 and as perforated sections 100 that can be selectively detached or removed from the pages 12-36.

Figure 3A:
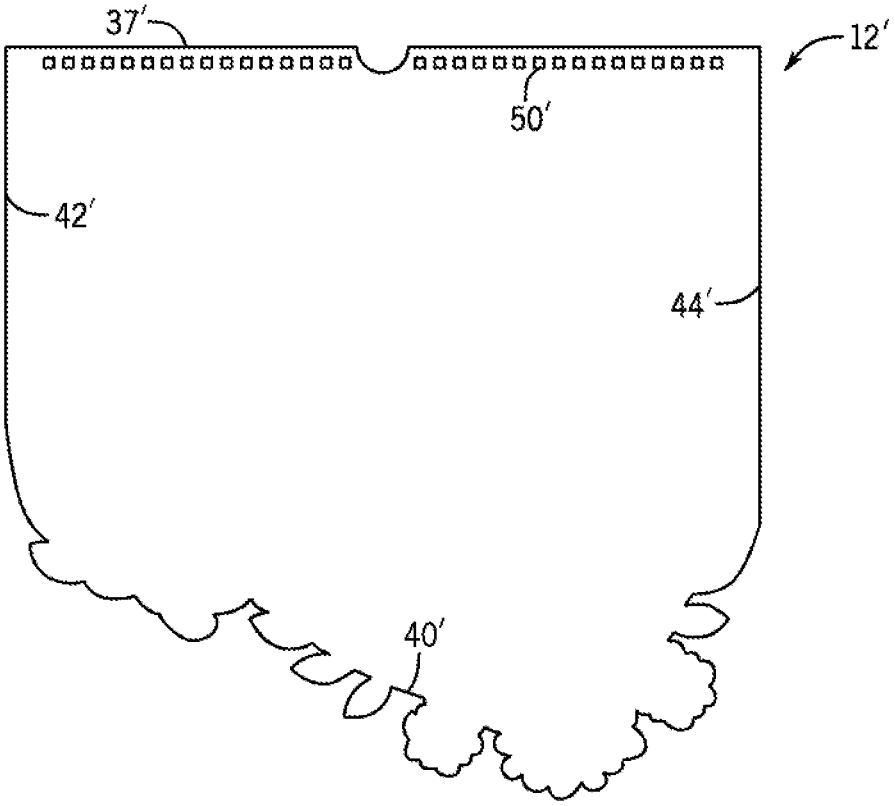
FIGS. 3A-3N are schematic views of a second exemplary embodiment of a calendar formed according to the present disclosure.
Figure 3B:
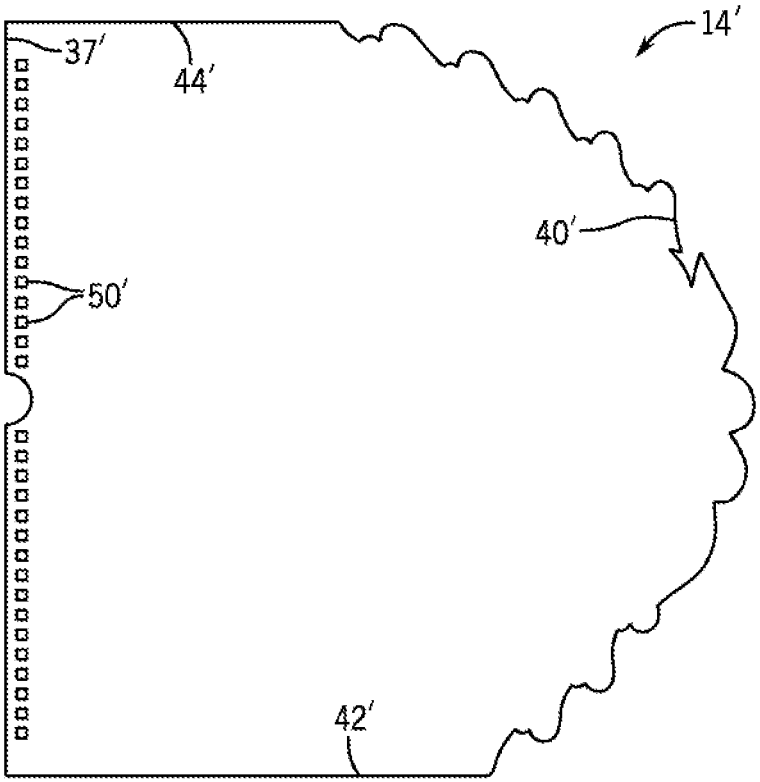
Figure 3C:
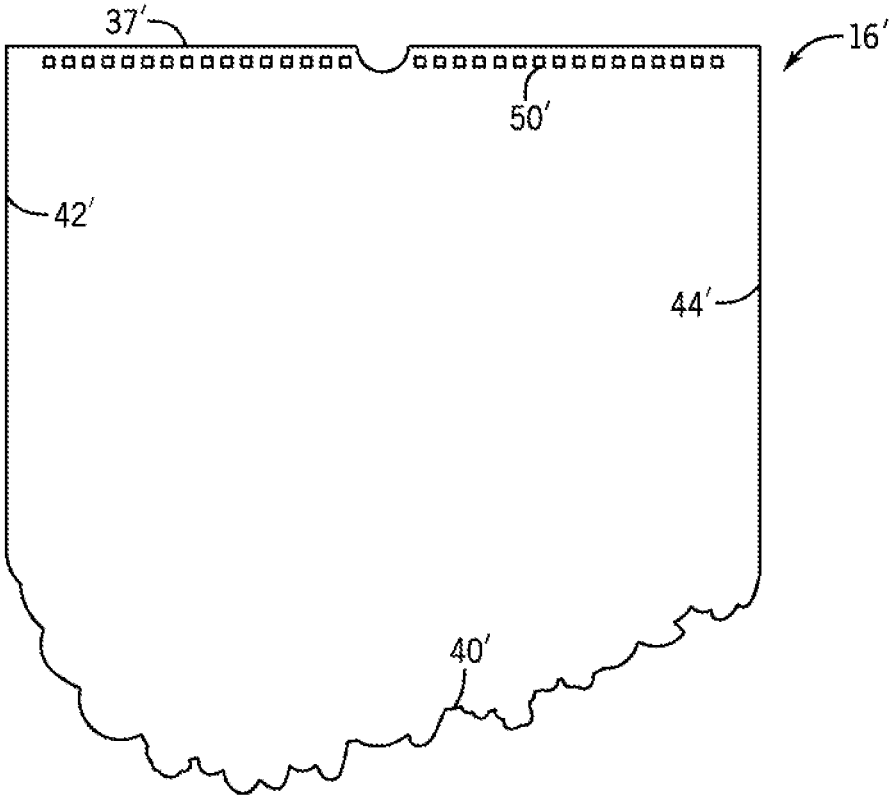
Figure 3D:
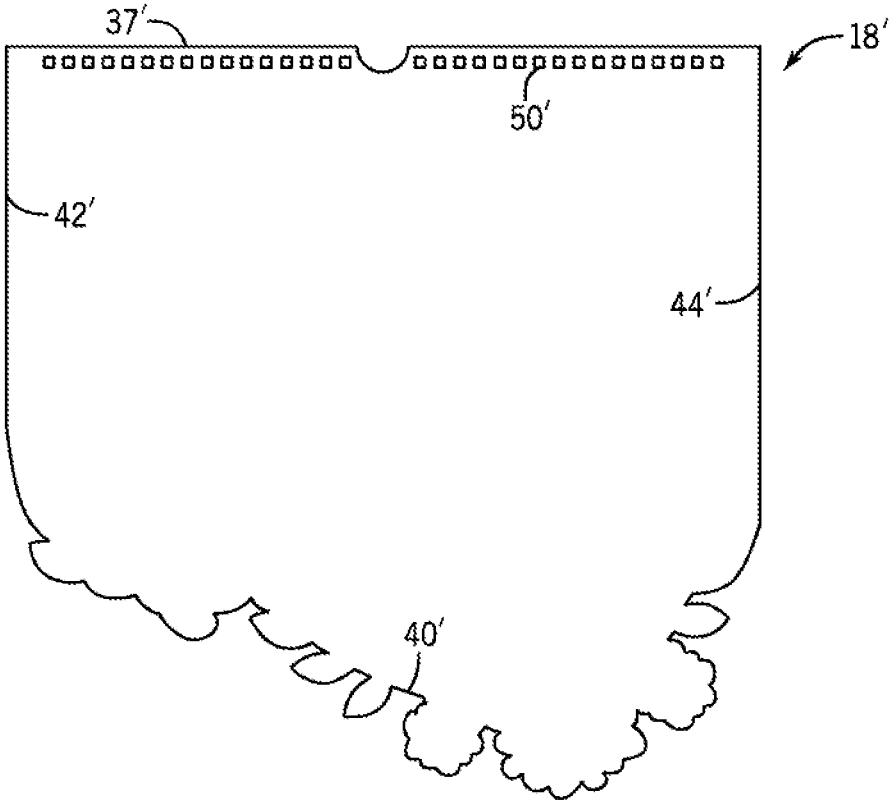
Figure 3E:
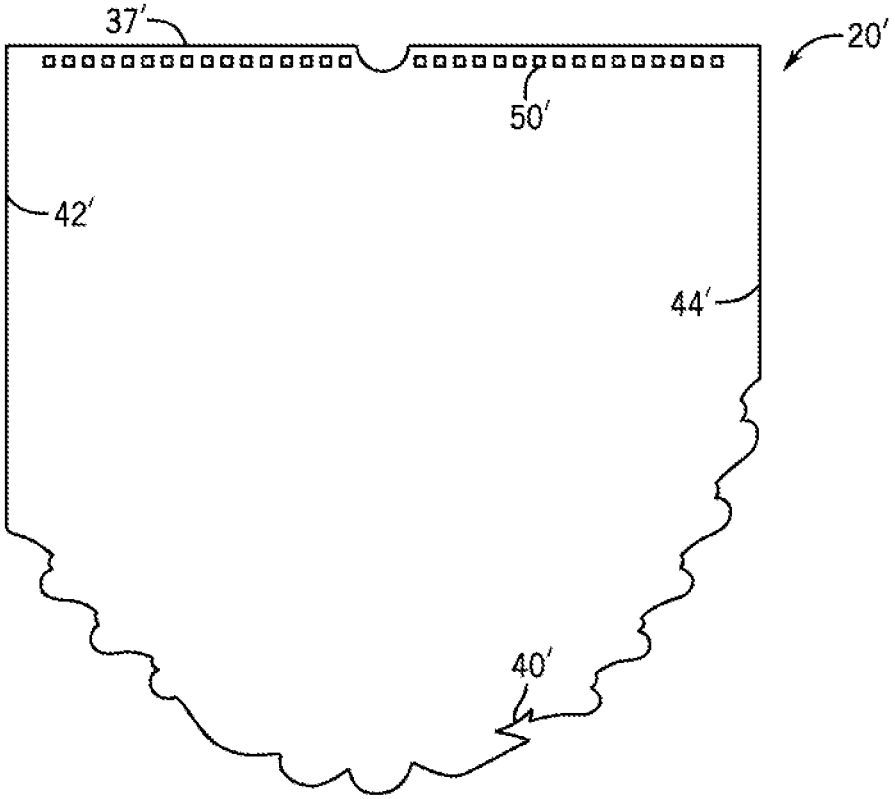
Figure 3F:
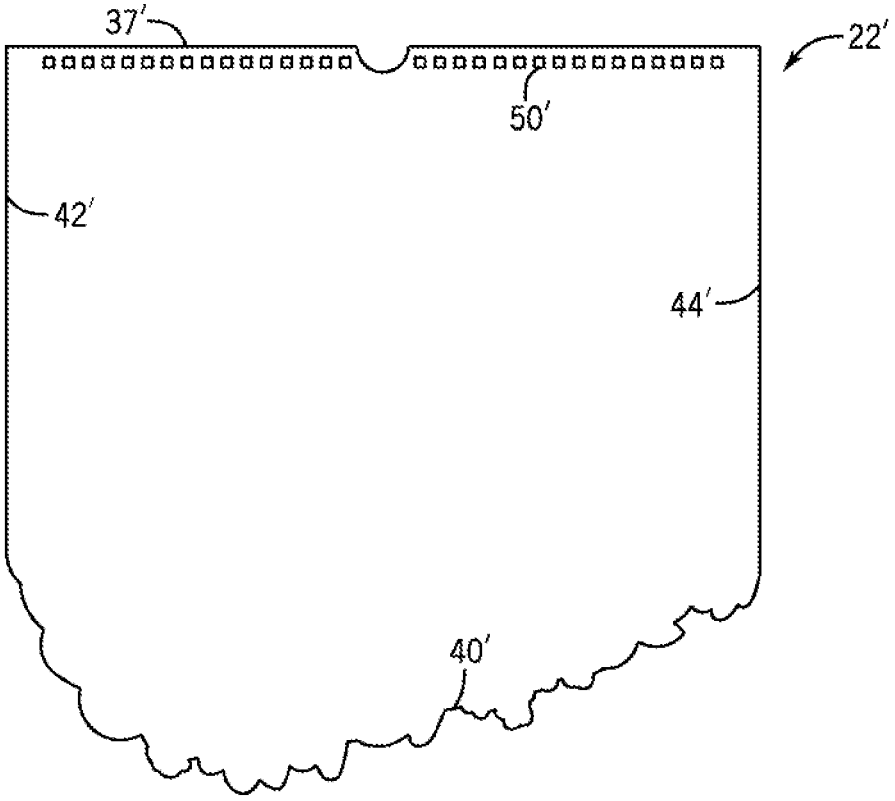
Figure 3G:
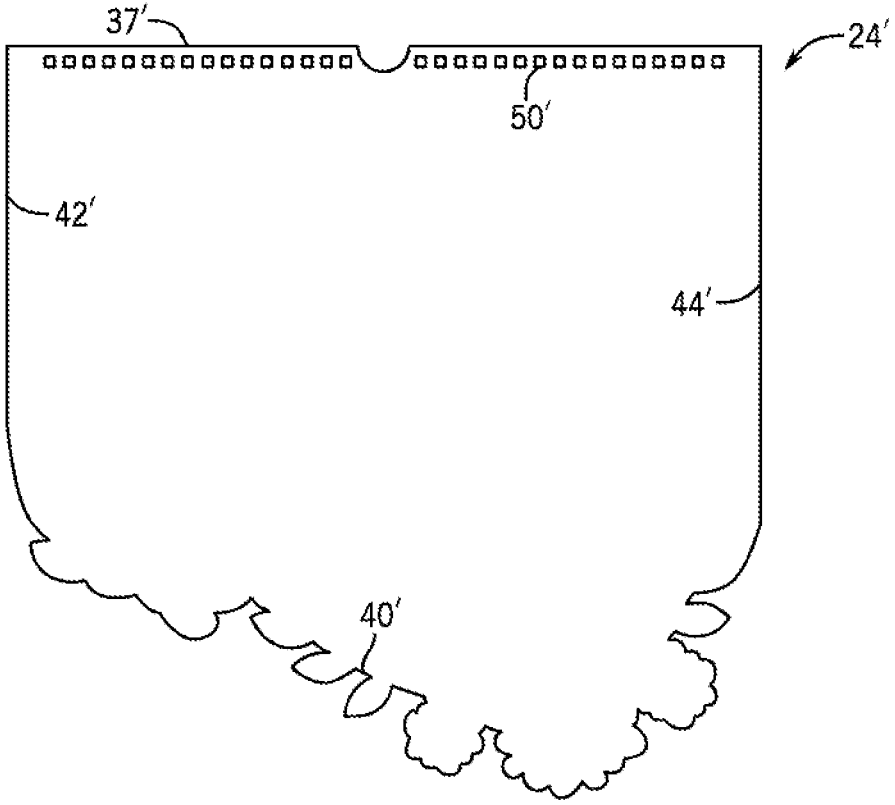
Figure 3H:
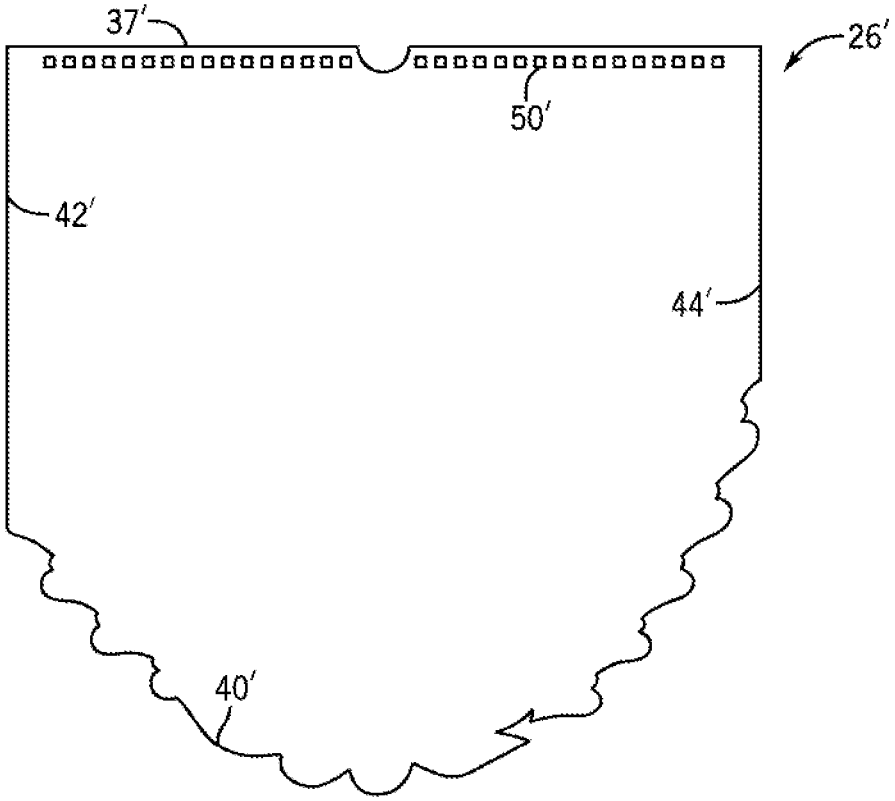
Figure 3I:
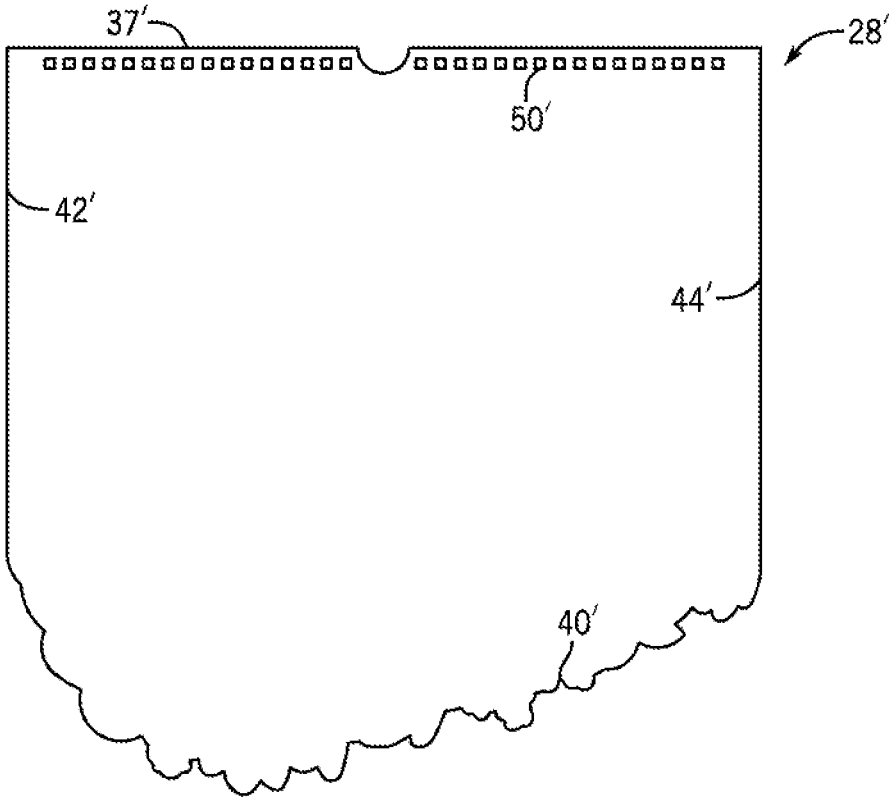
Figure 3J:
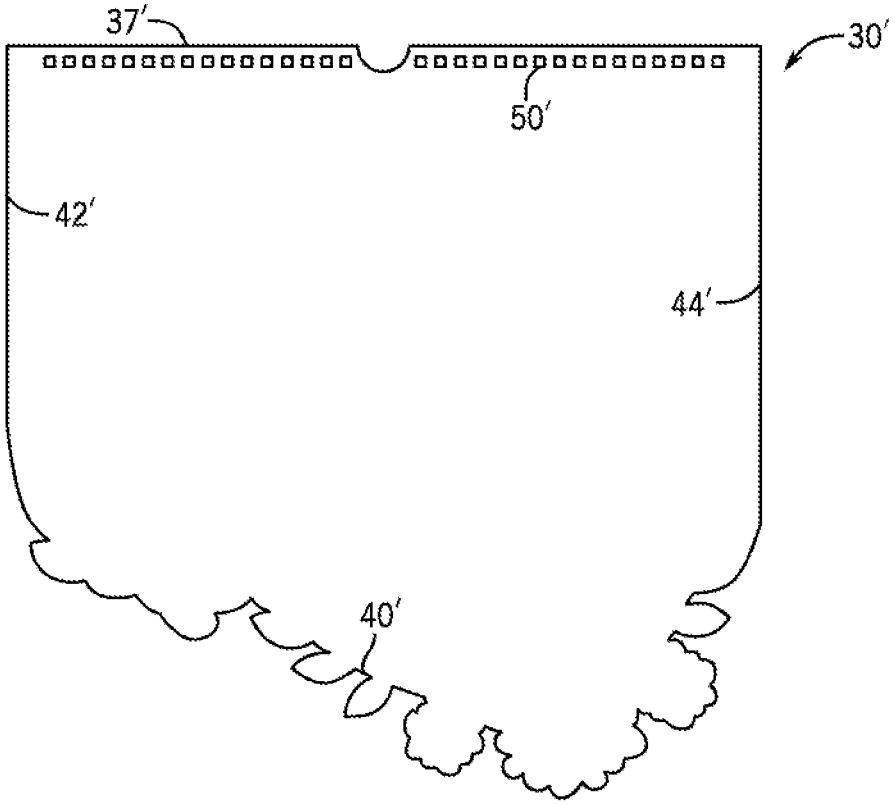
Figure 3K:
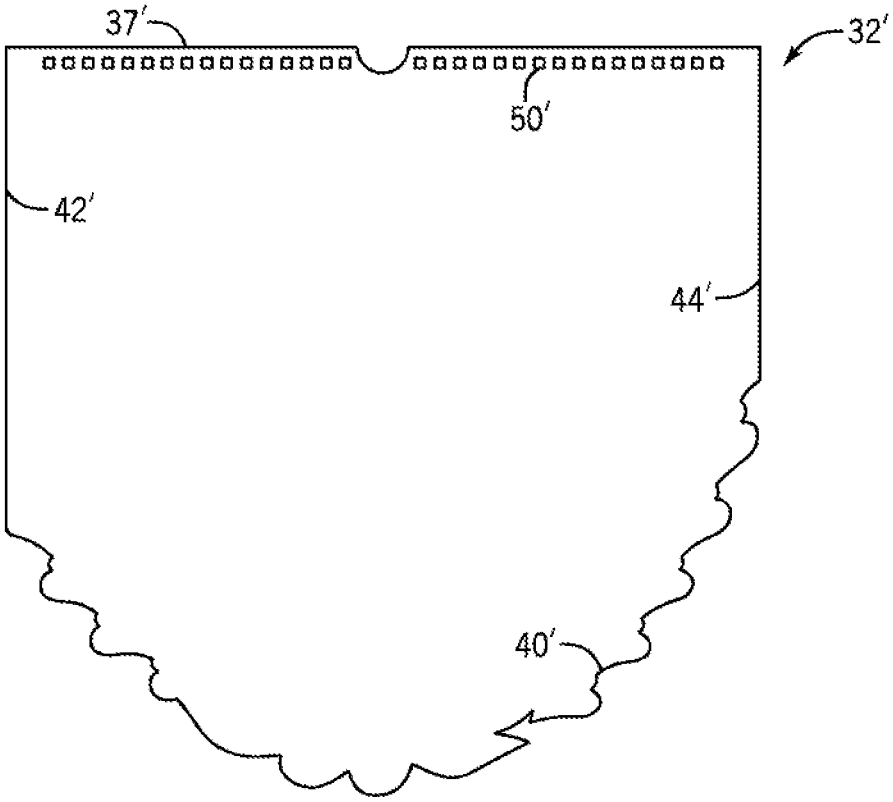
Figure 3L:
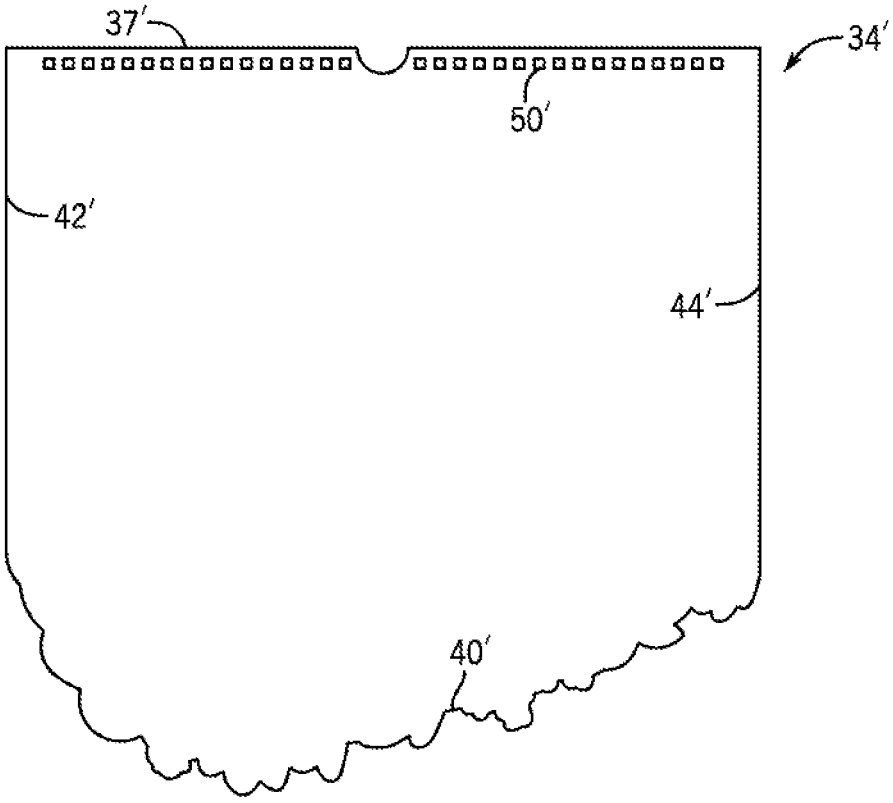
Figure 3M:
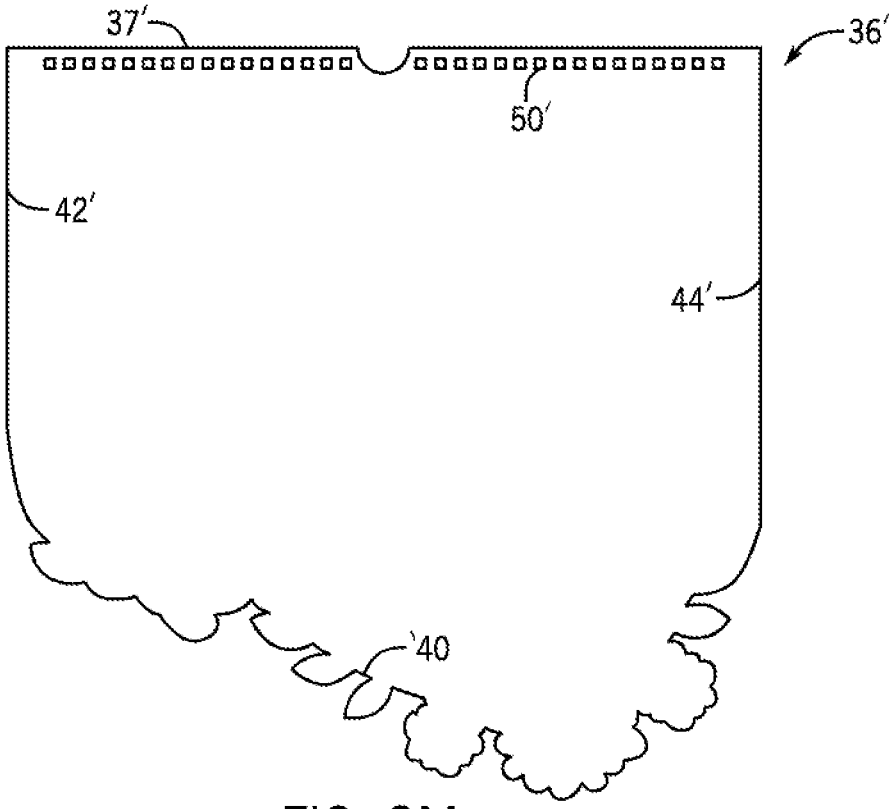
Figure 3N:
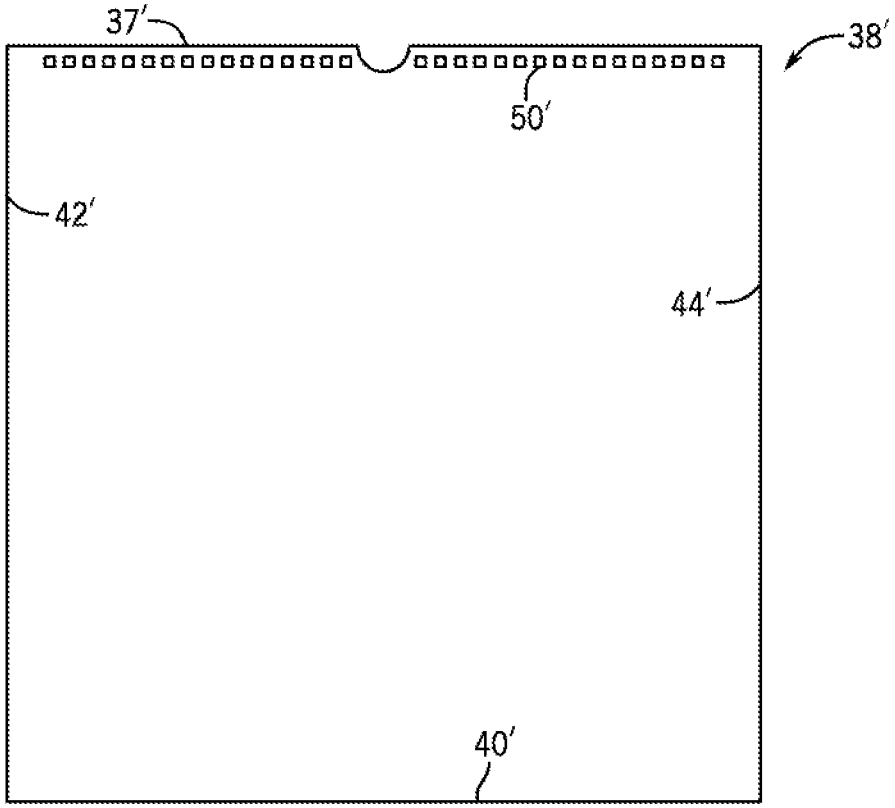

Looking now at the exemplary embodiment of FIGS. 3A-3N, instead of apertures 52, each of the pages 12'-36' of the calendar 10' is formed similarly to those of the calendar 10 but with a differently shaped bottom edge 40', though other edges 38', 42', 44' can also or alternatively be formed differently in alternative embodiments. The bottom edges 40' of the various pages 12'-38' form a layered, three-dimensional decorative image and/or appearance for the calendar 10', except for page 38' which has a straight bottom edge 40' to provide a backdrop for the differently shaped bottom edges 40' of the remainder of the pages 12'-36'. The pages 12'-36' also include indicia 56', such as printed indicia 56', thereon, on various portions of the pages 12'-38' and particularly at the bottom edges 40' in order to provide the coordinated decorative appearance to the calendar 10'.

Figure 4:
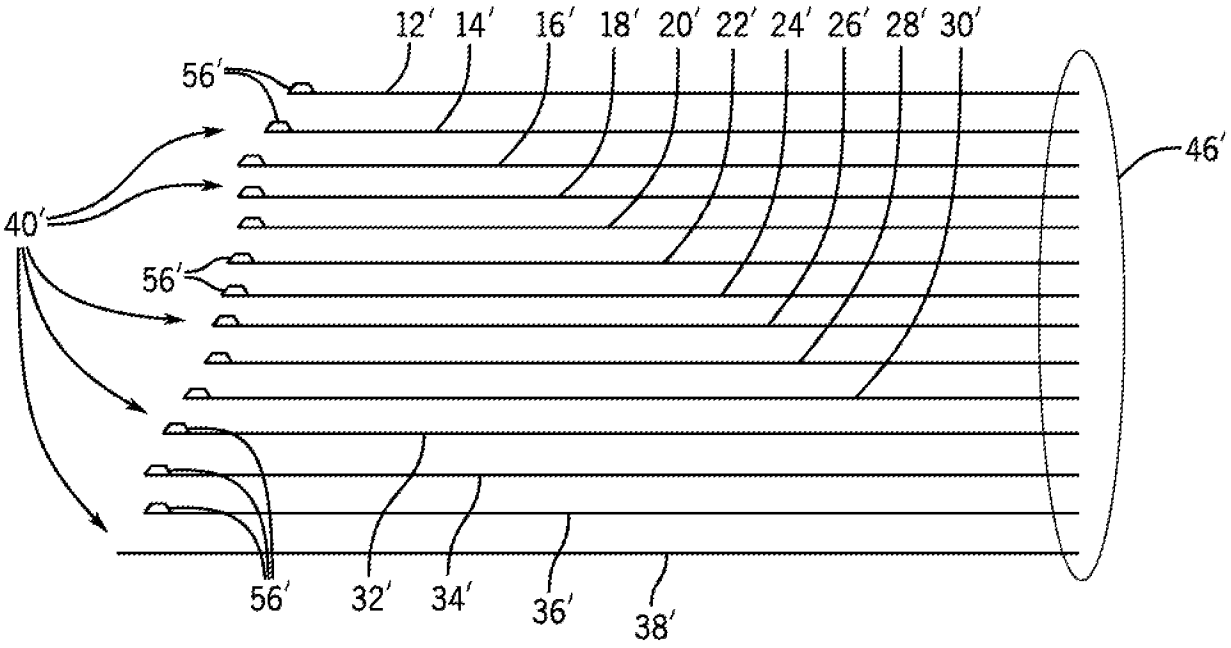
FIG. 4 is cross-sectional view of the calendar of FIGS. 3A-3N.
Figure 5A:
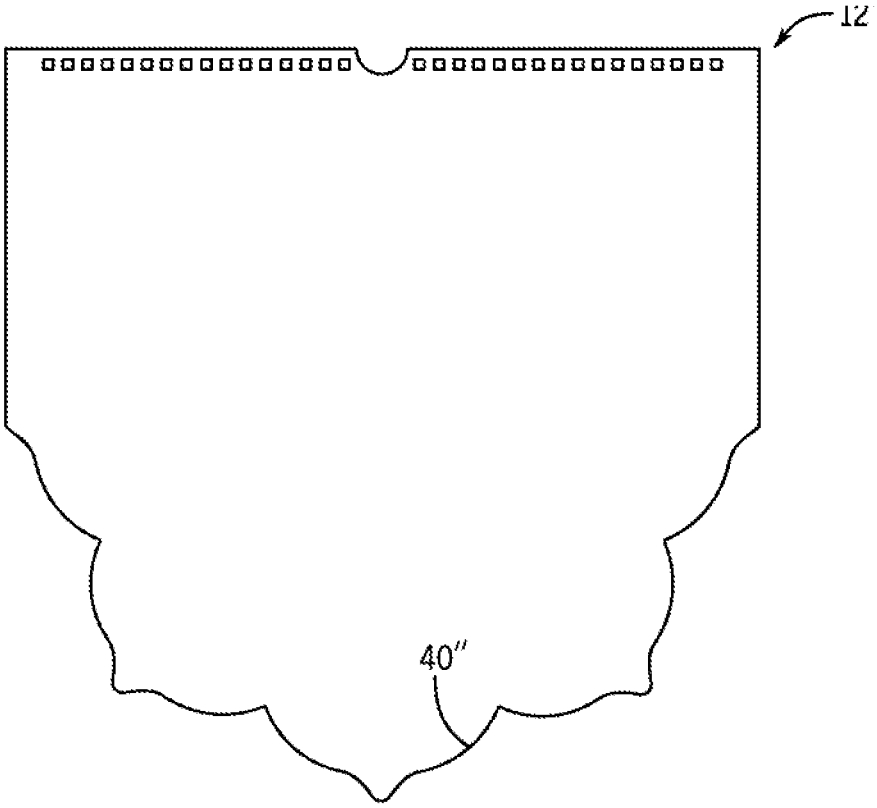
FIGS. 5A-5M are schematic views of a third exemplary embodiment of a calendar formed according to the present disclosure.
Figure 5B:
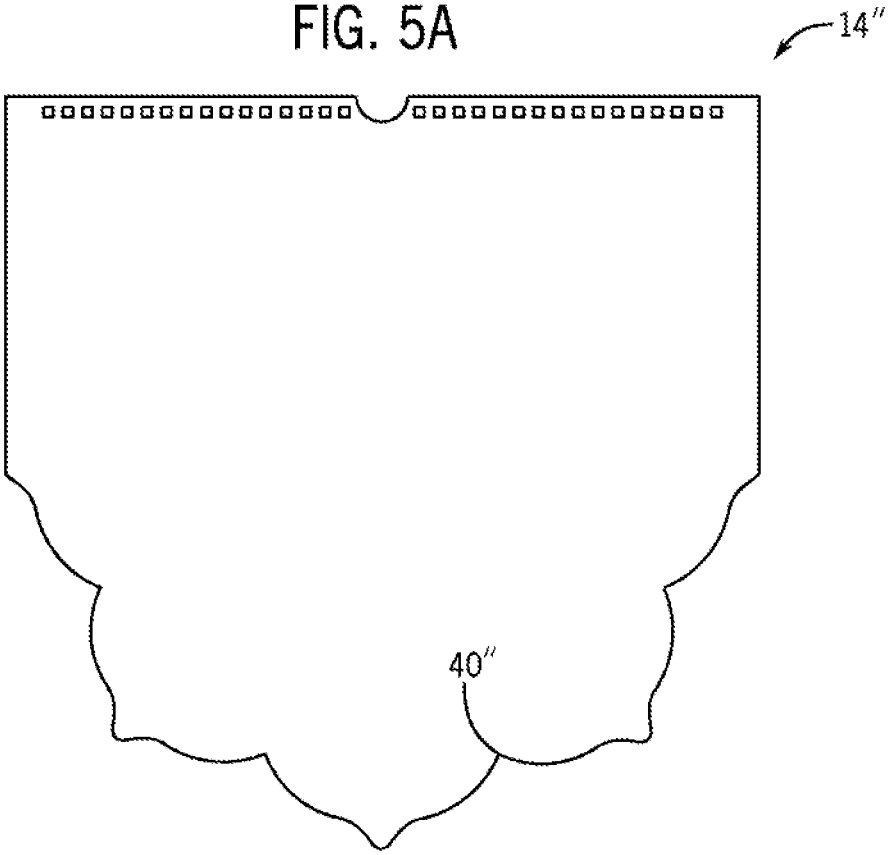
Figure 5C:
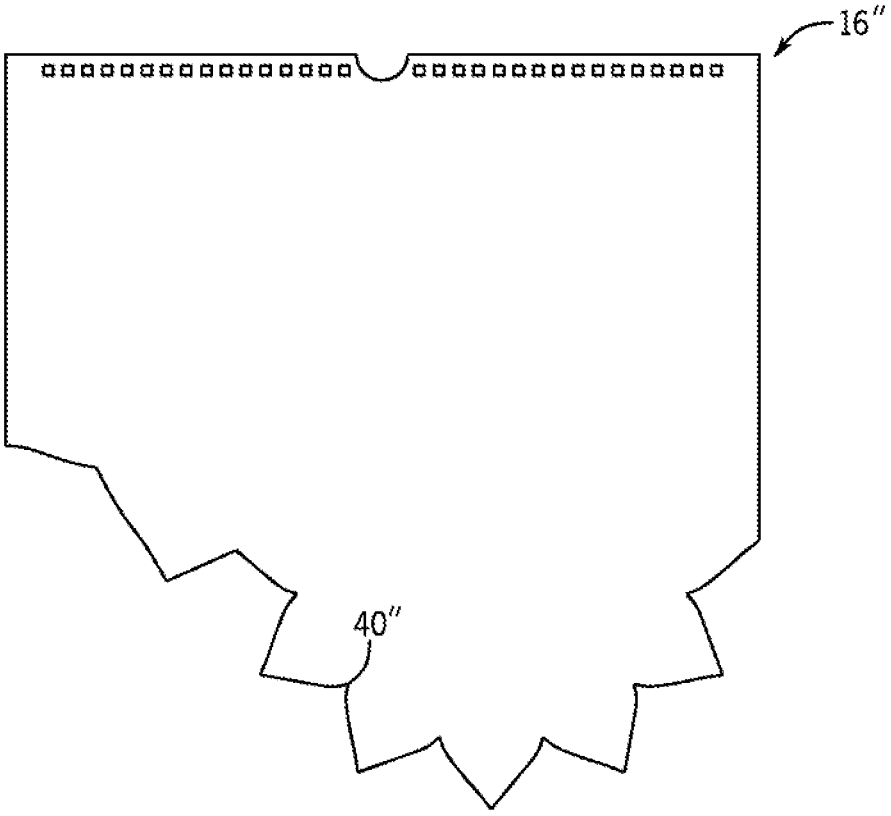
Figure 5D:
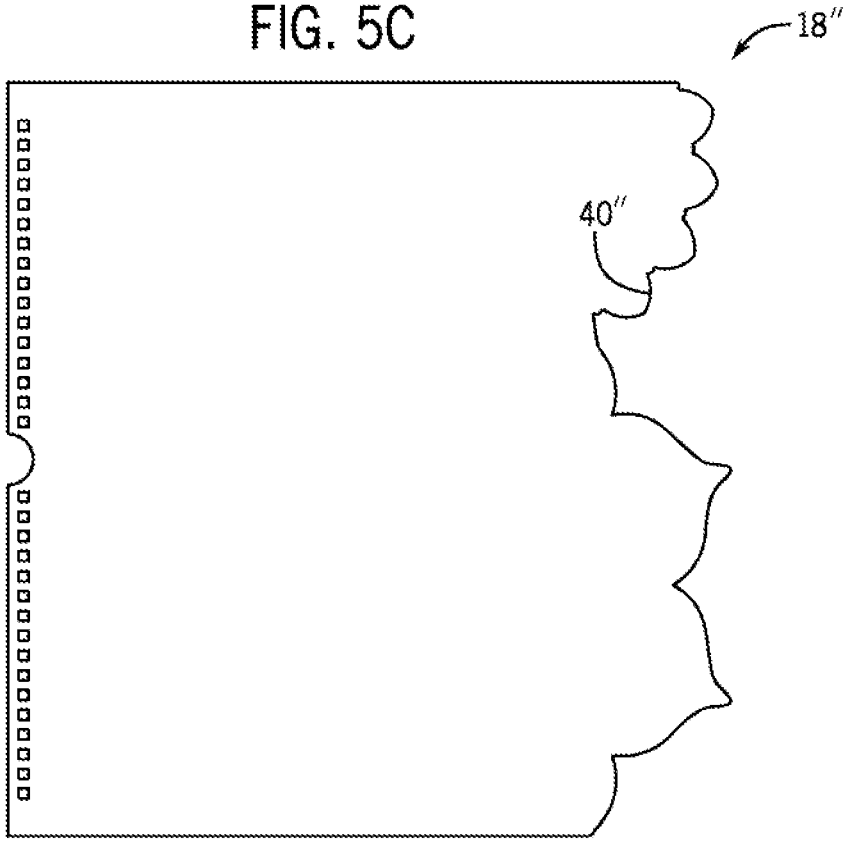
Figure 5E:
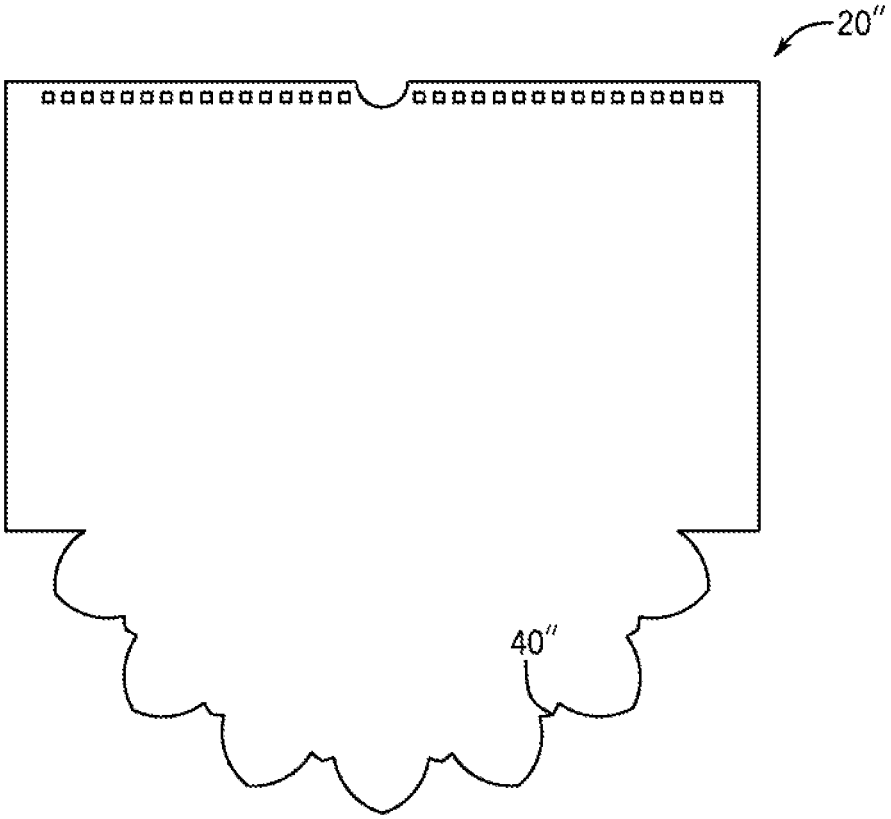
Figure 5F:
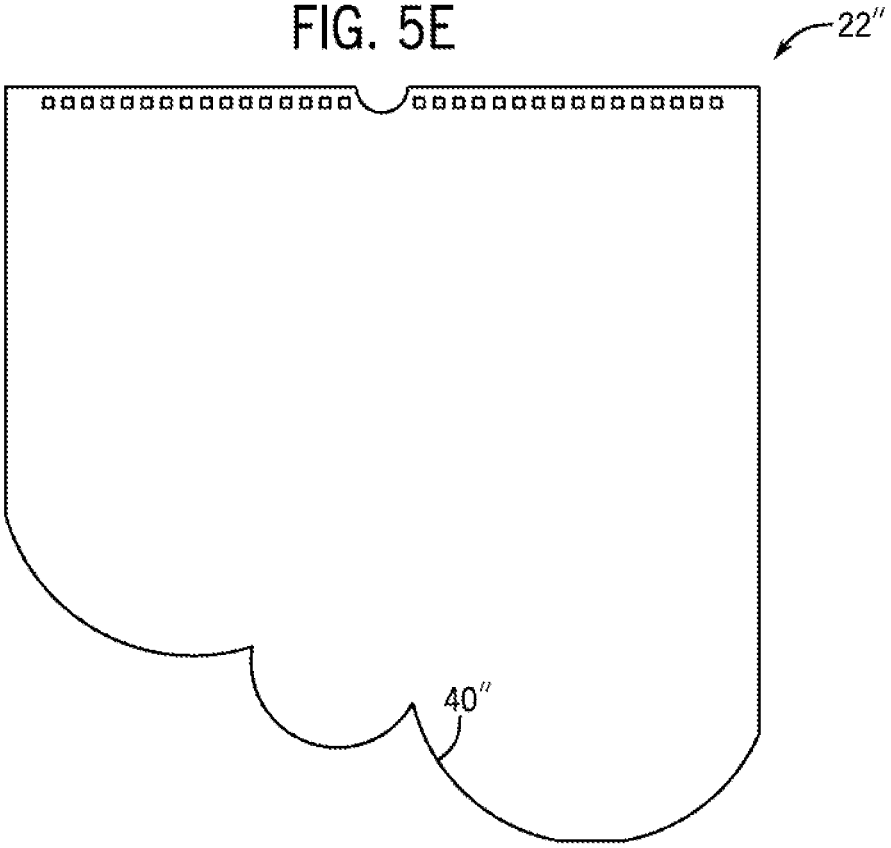
Figure 5G:
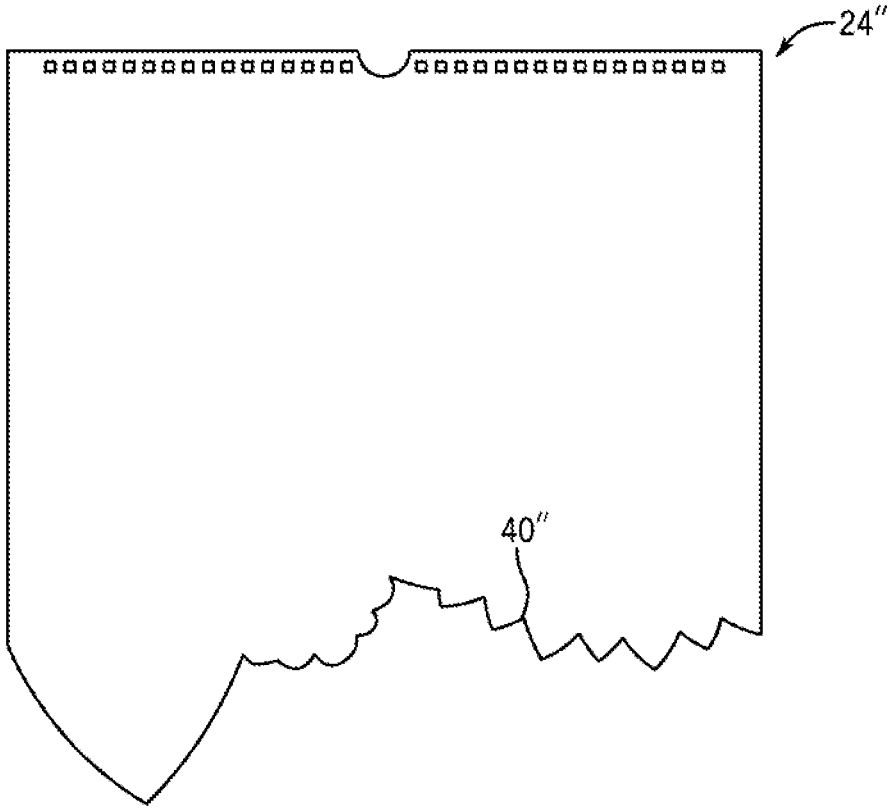
Figure 5H:
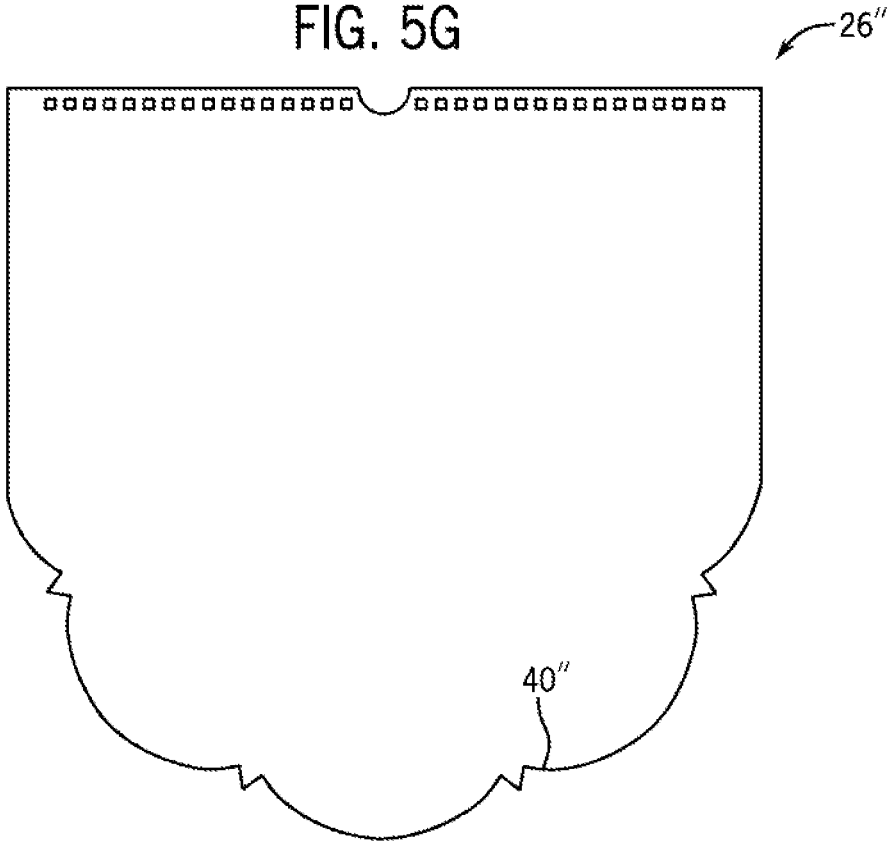
Figure 5I:
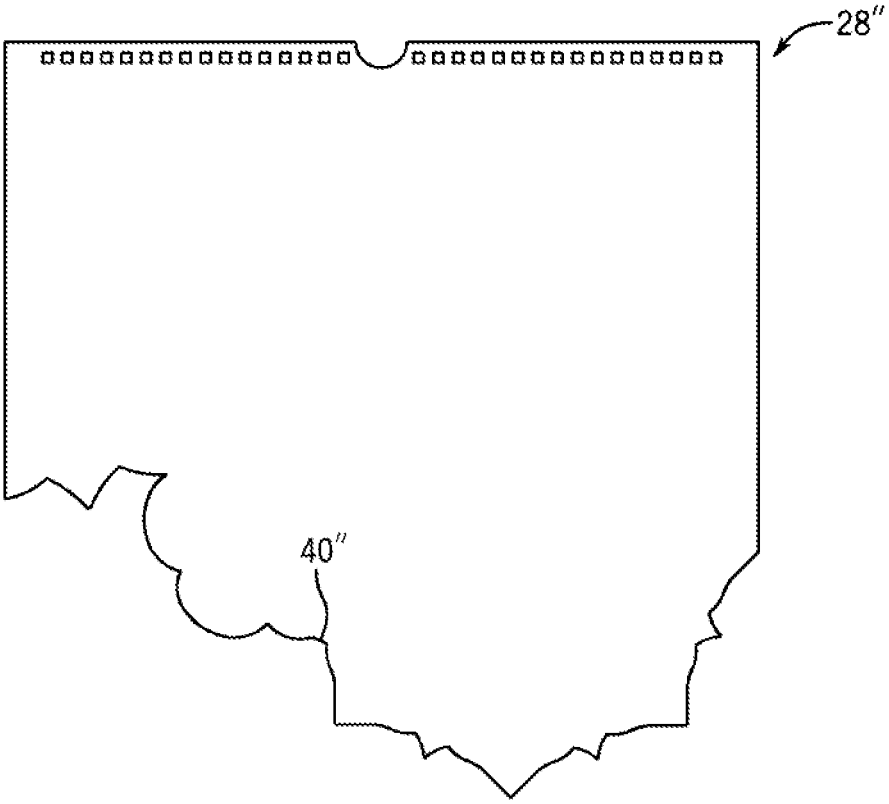
Figure 5J:
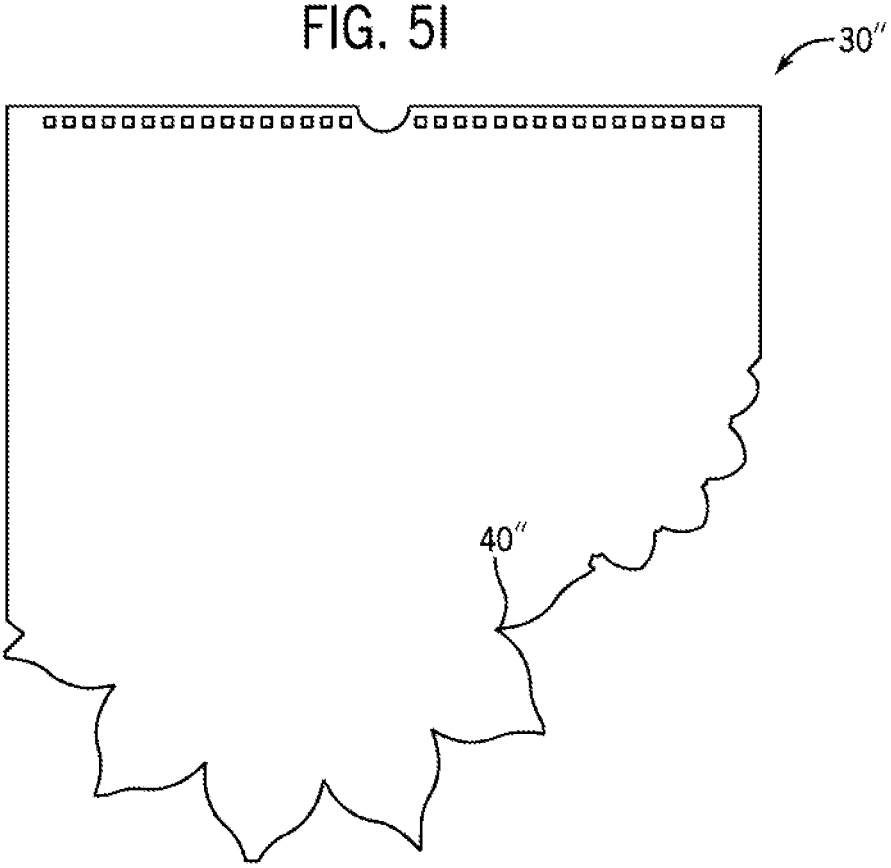
Figure 5K:
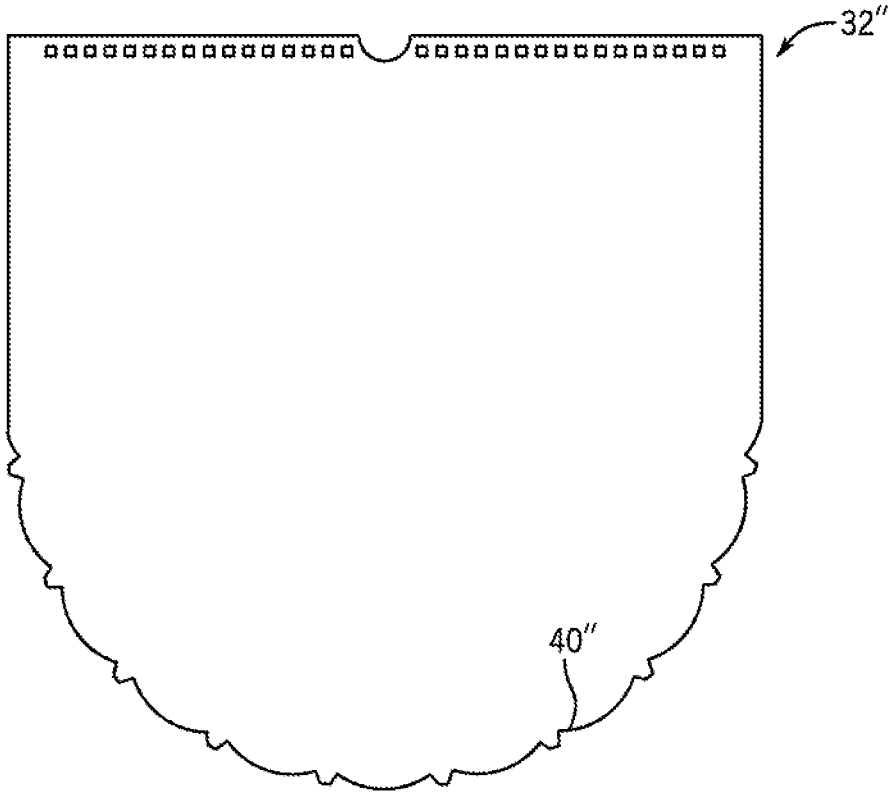
Figure 5L:
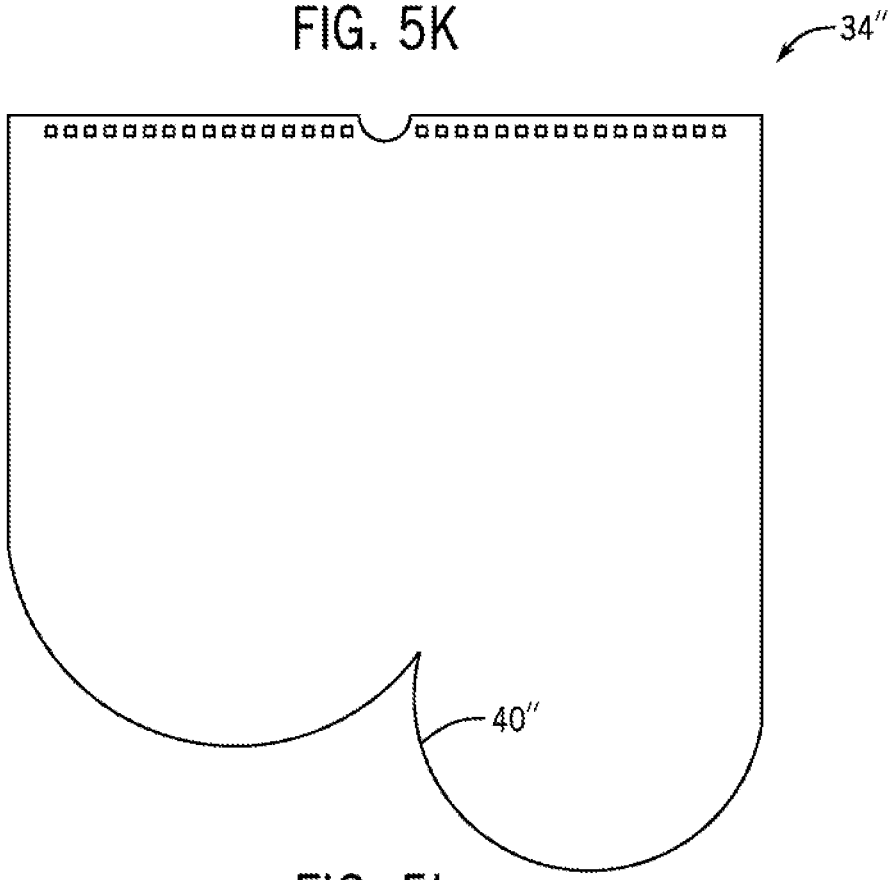
Figure 5M:
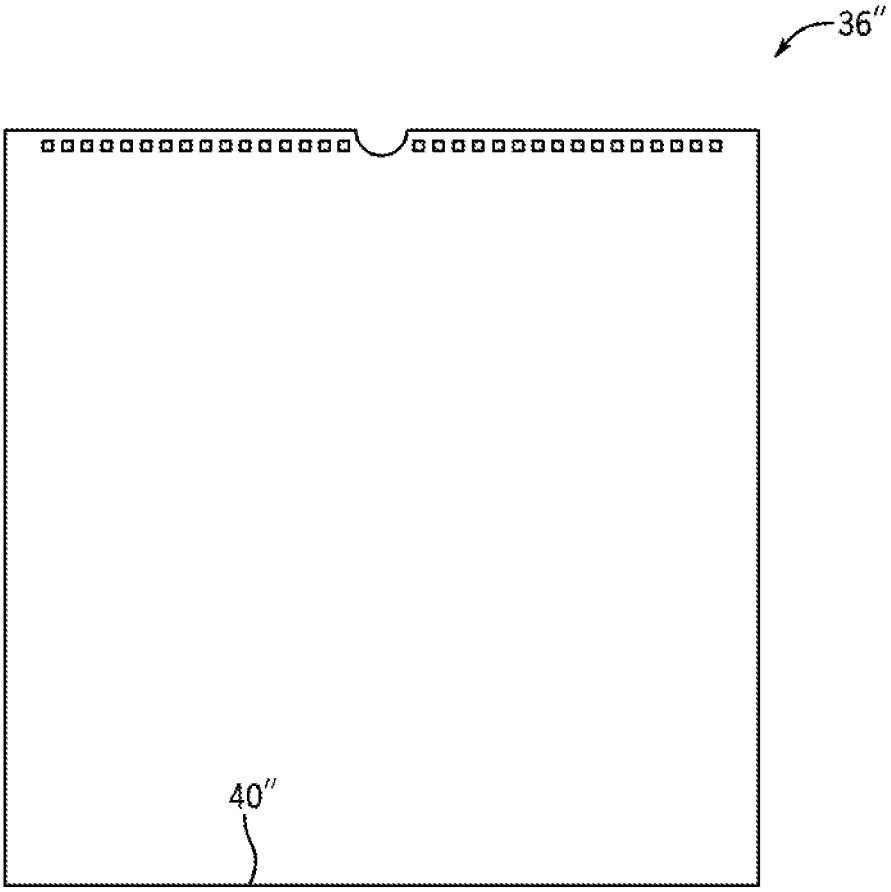
Figure 6A:
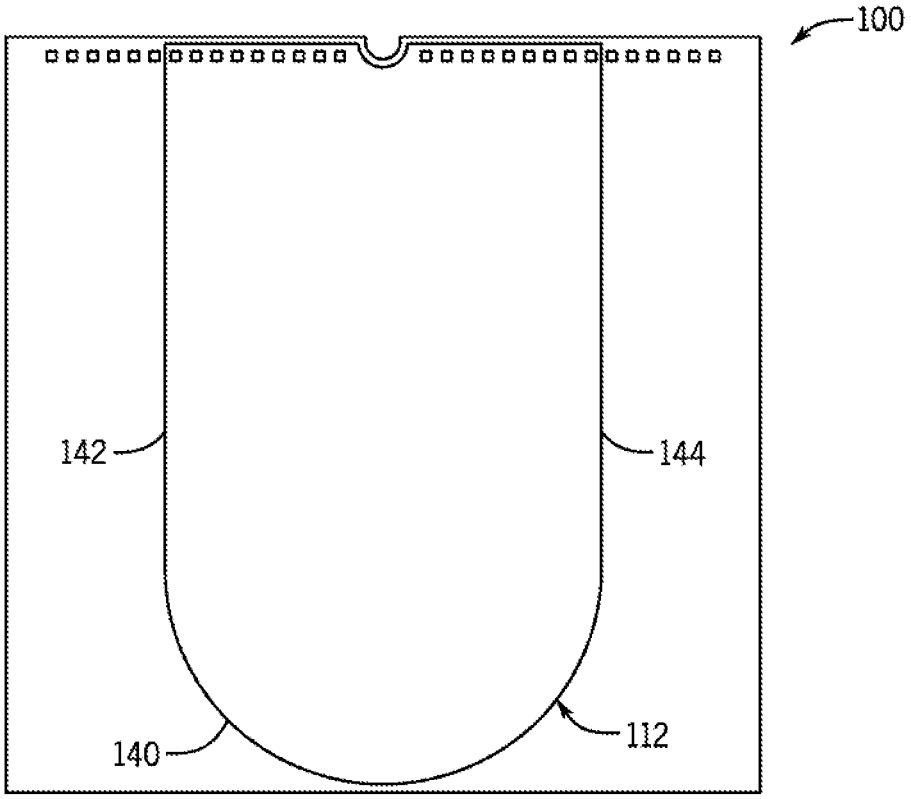
FIGS. 6A-6M are schematic views of a fourth exemplary embodiment of a calendar formed according to the present disclosure.
Figure 6B:
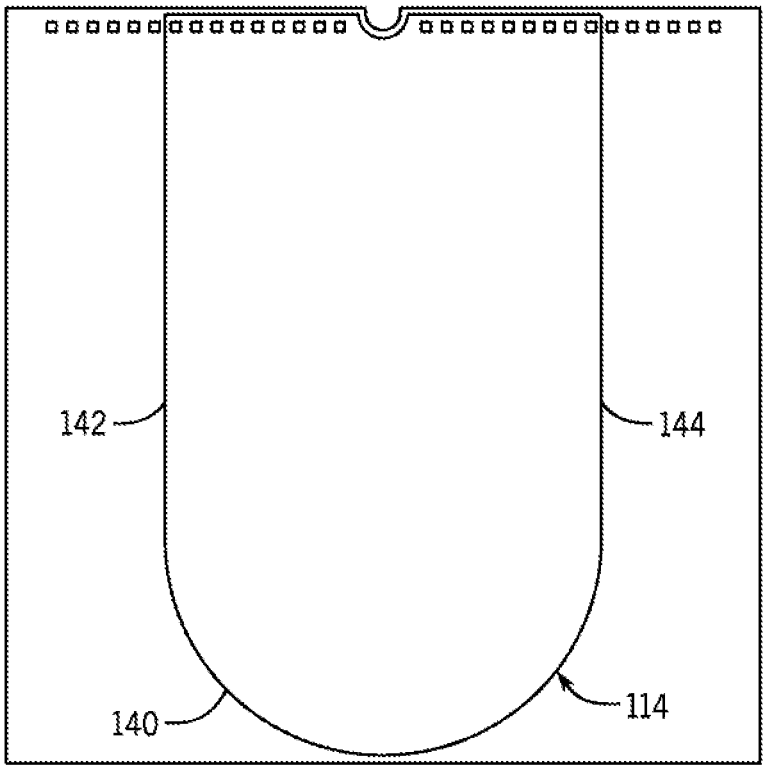
Figure 6C:
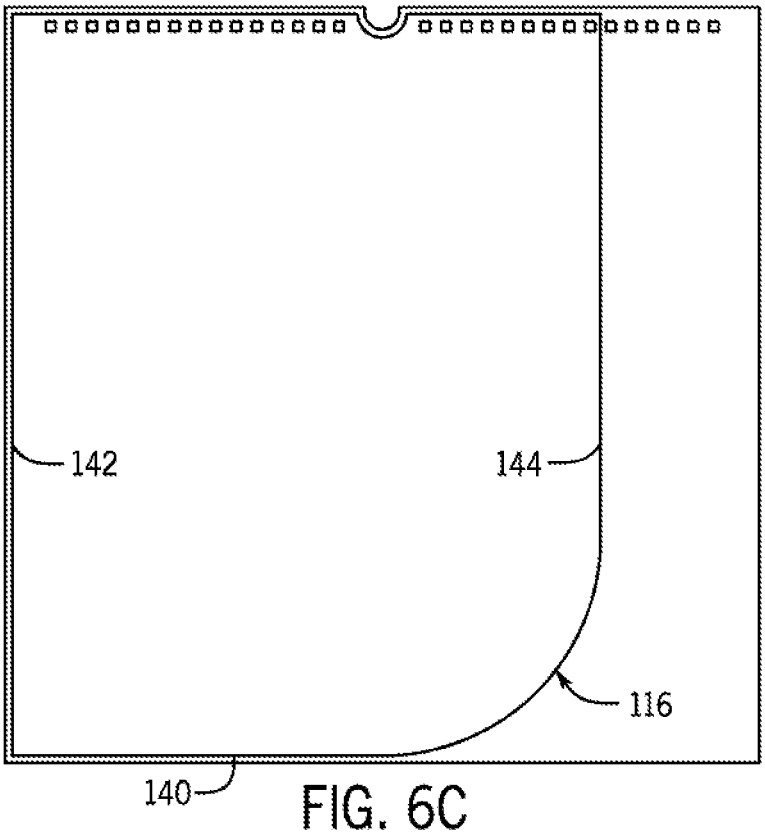
Figure 6D:
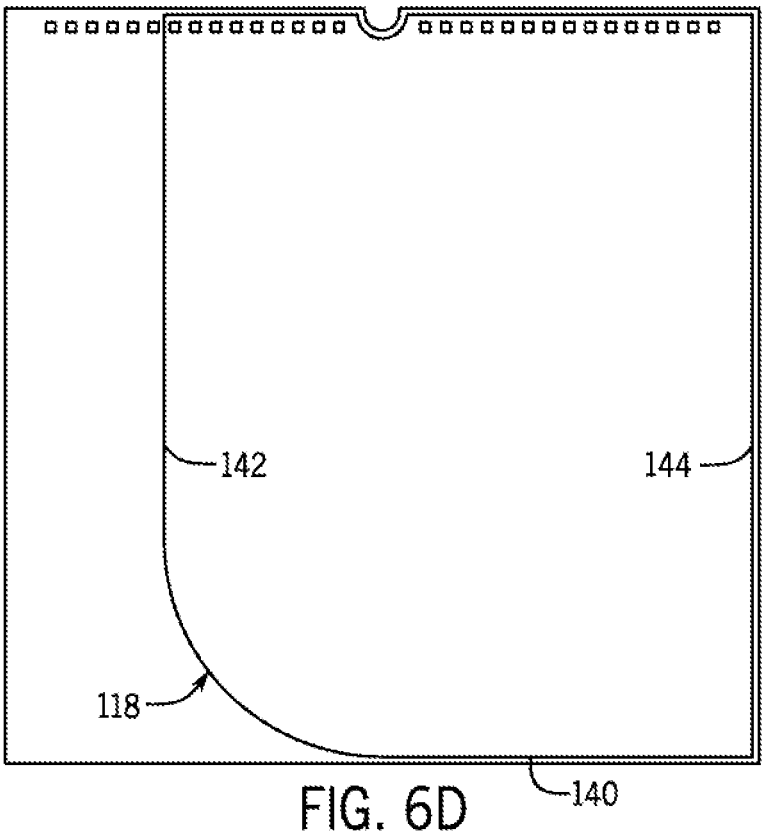
Figure 6E:
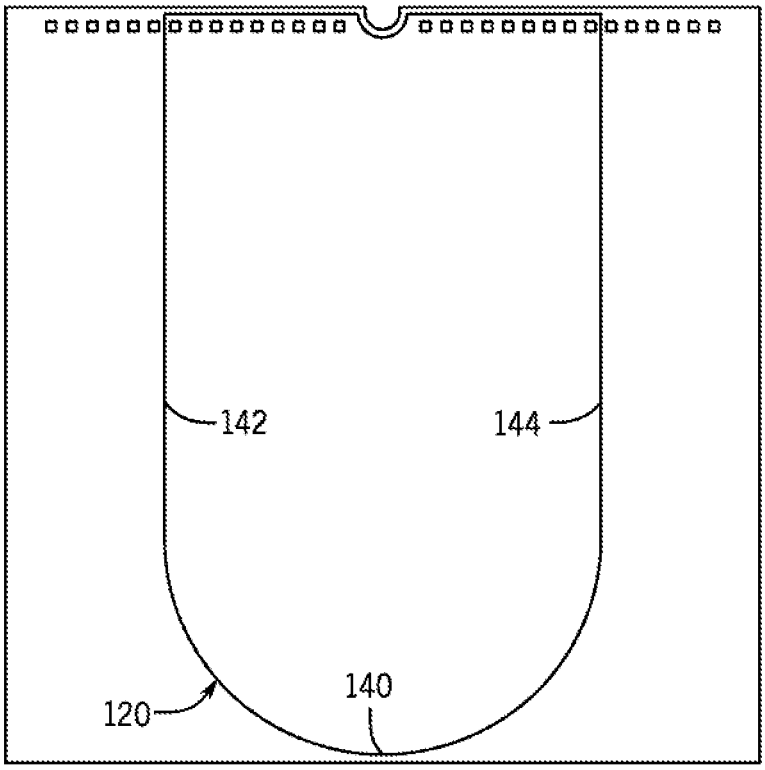
Figure 6F:
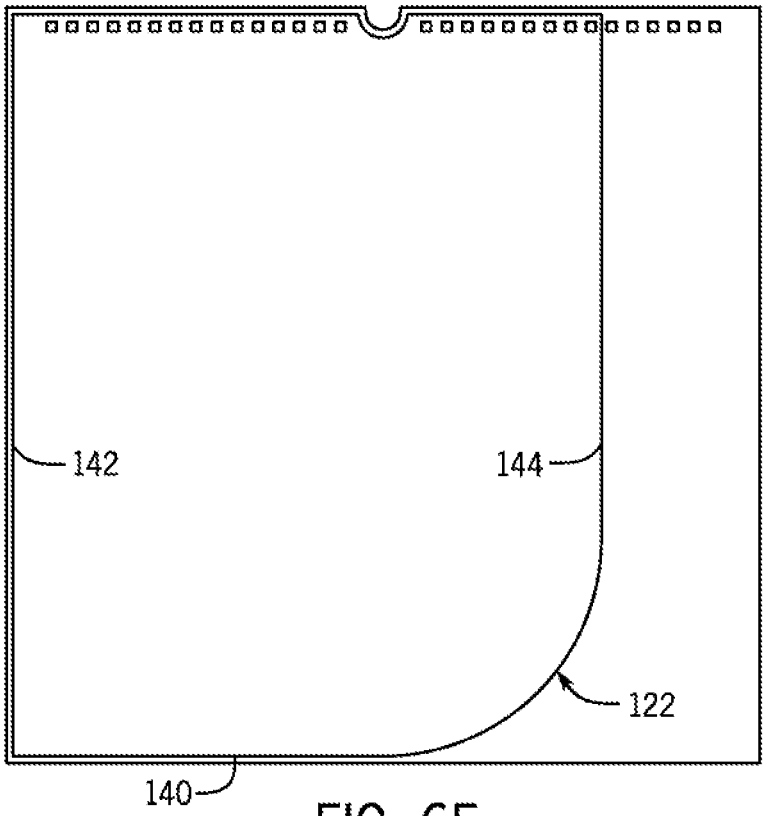
Figure 6G:
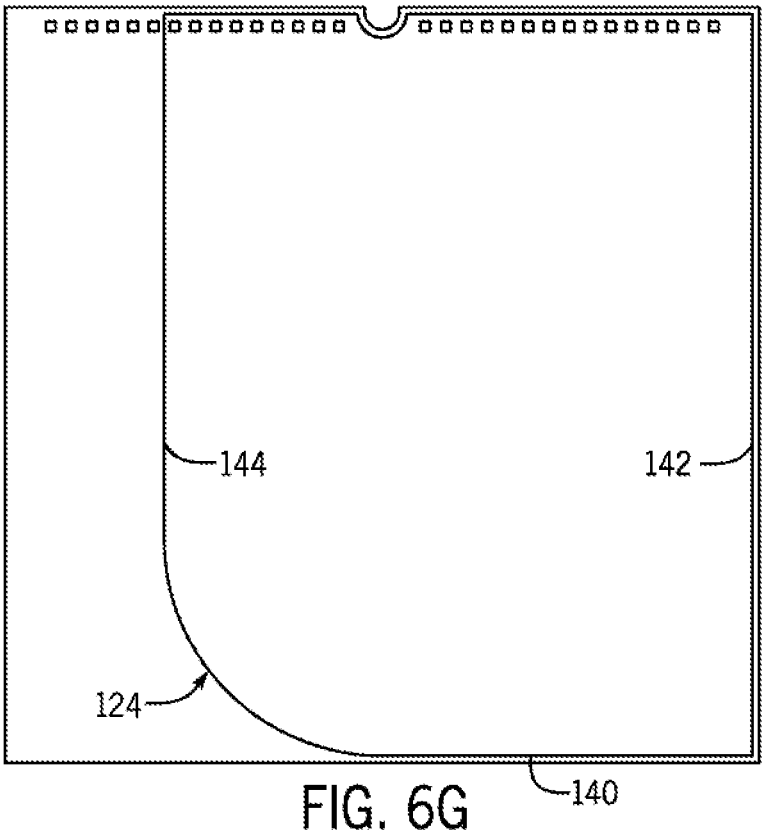
Figure 6H:
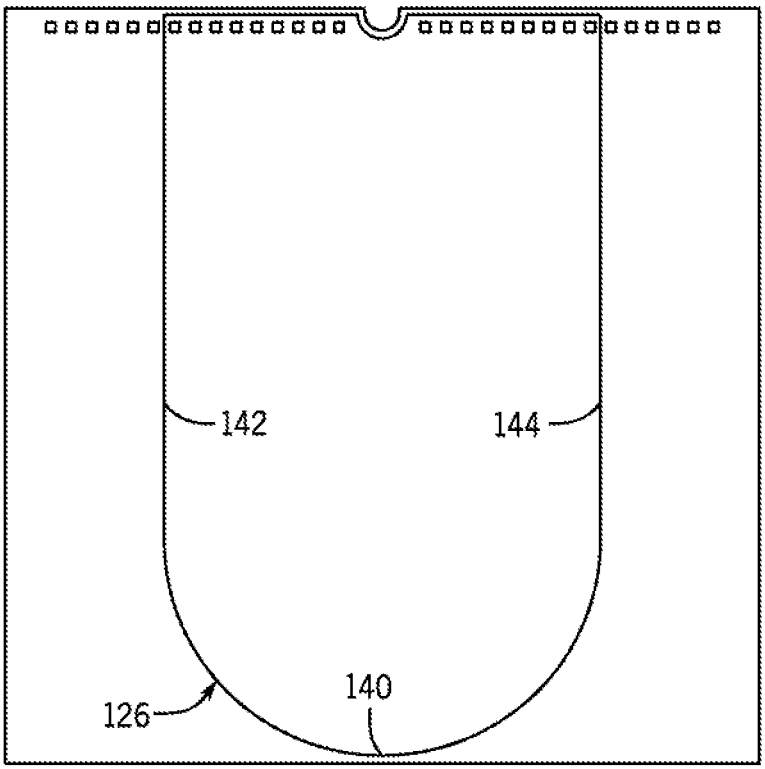
Figure 6I:
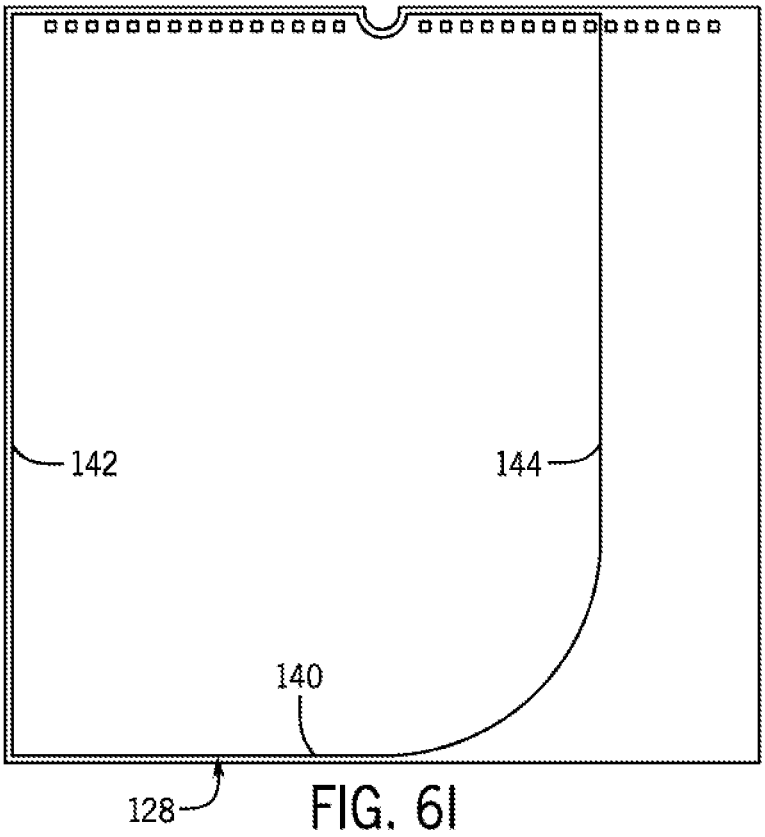
Figure 6J:
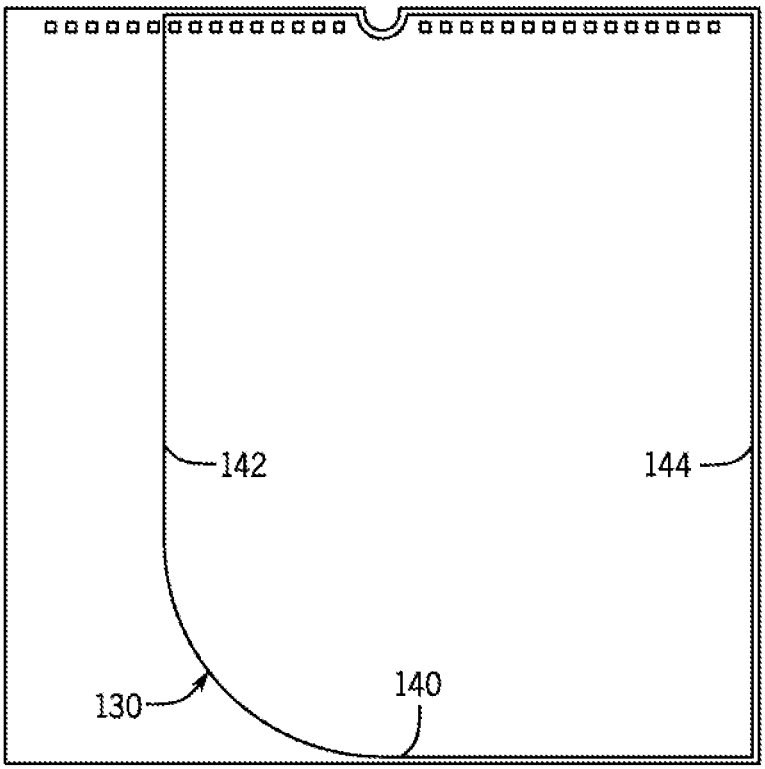
Figure 6K:
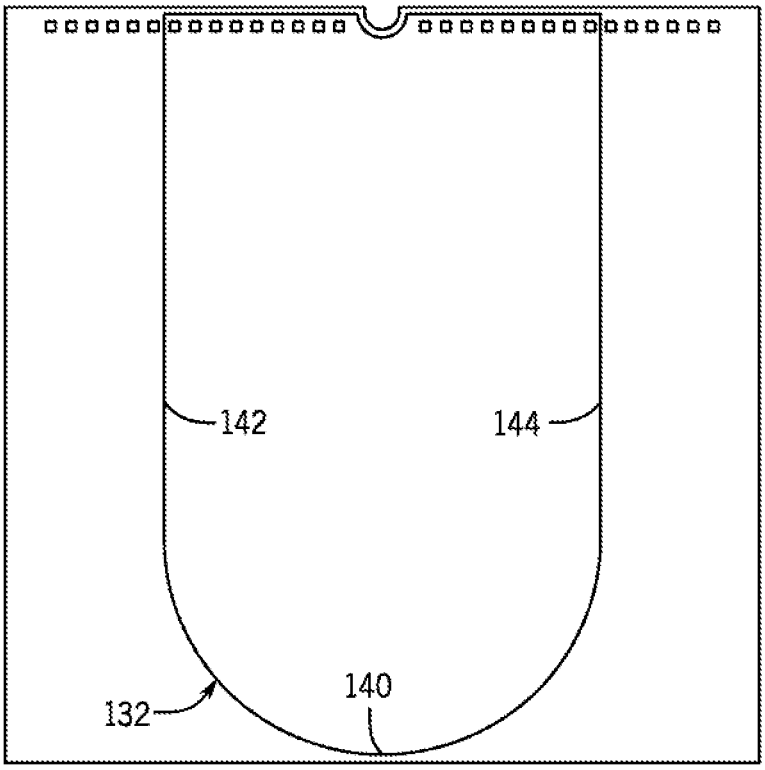
Figure 6L:
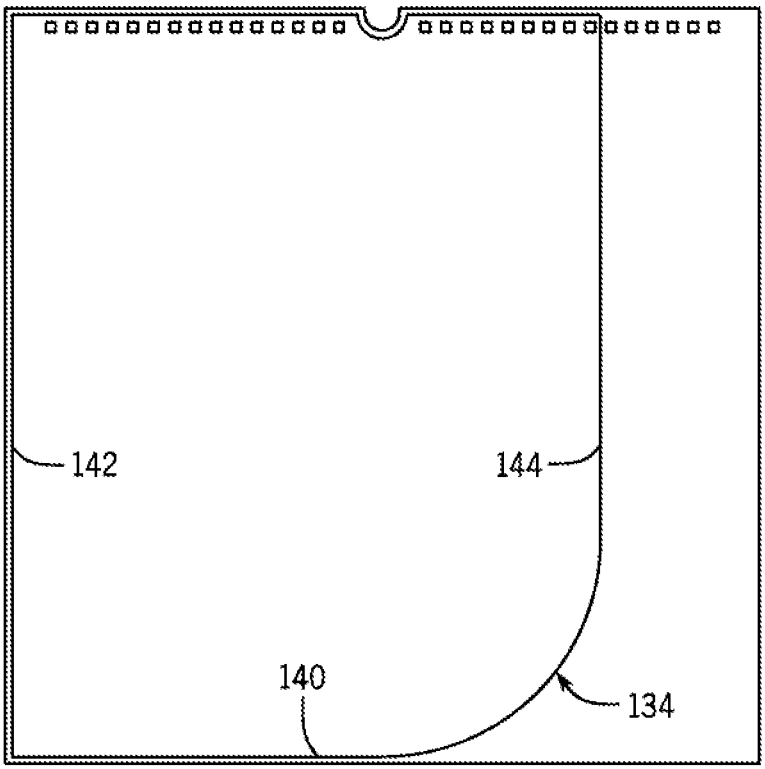
Figure 6M:
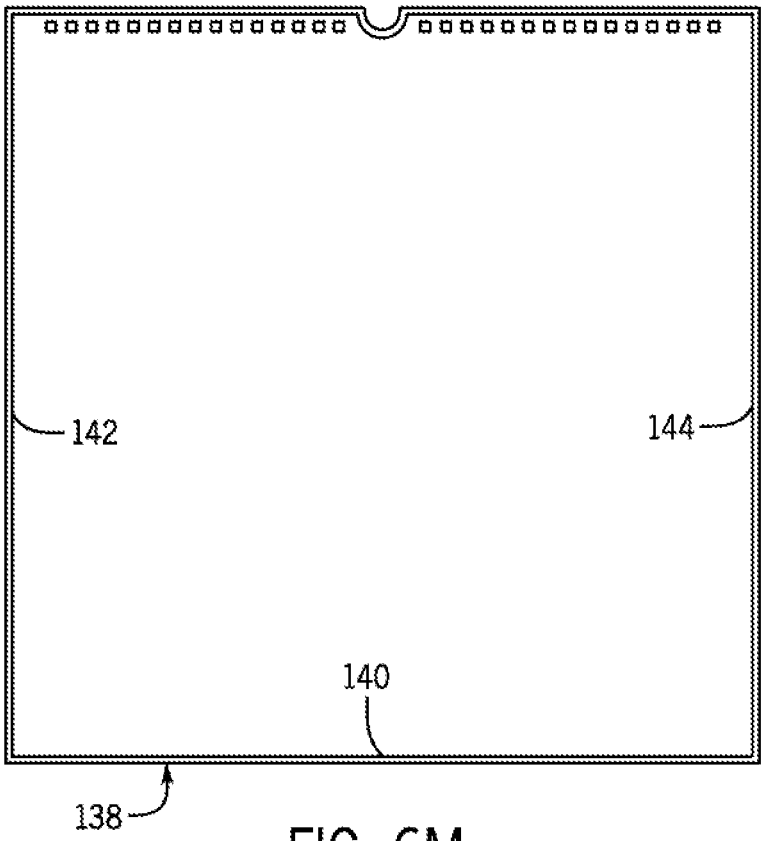
Figure 7A:
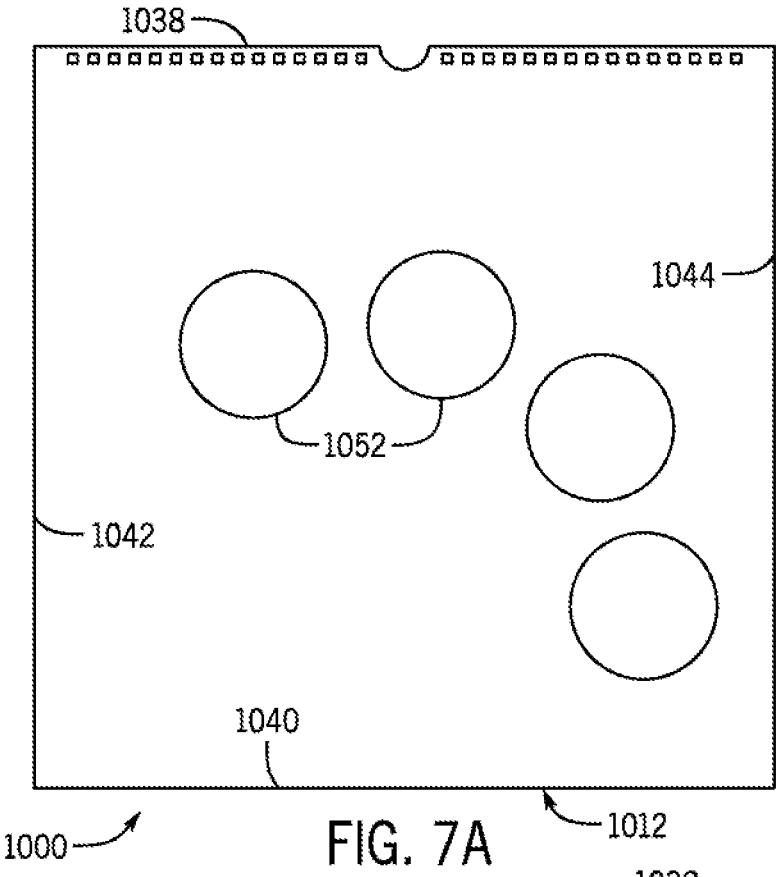
FIGS. 7A-7M are schematic views of a fifth exemplary embodiment of a calendar formed according to the present disclosure.
Figure 7B:
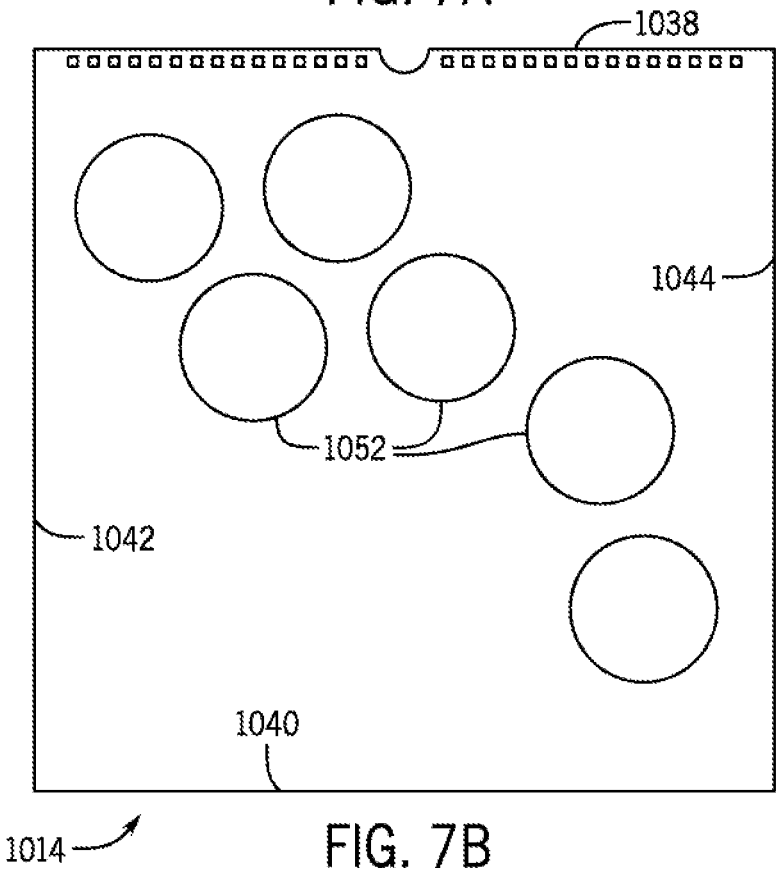
Figure 7C:
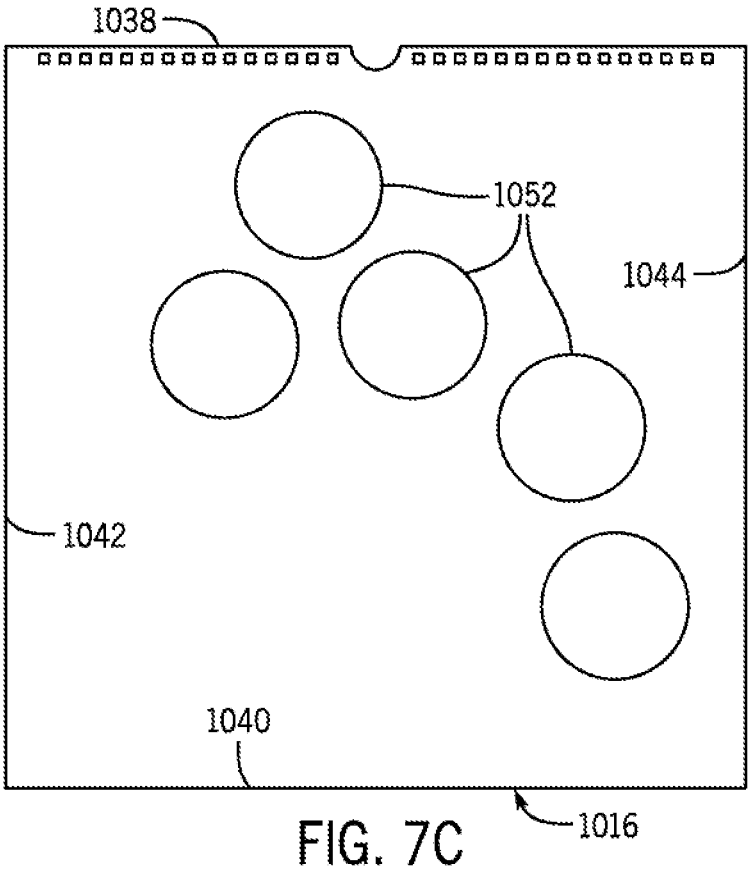
Figure 7D:
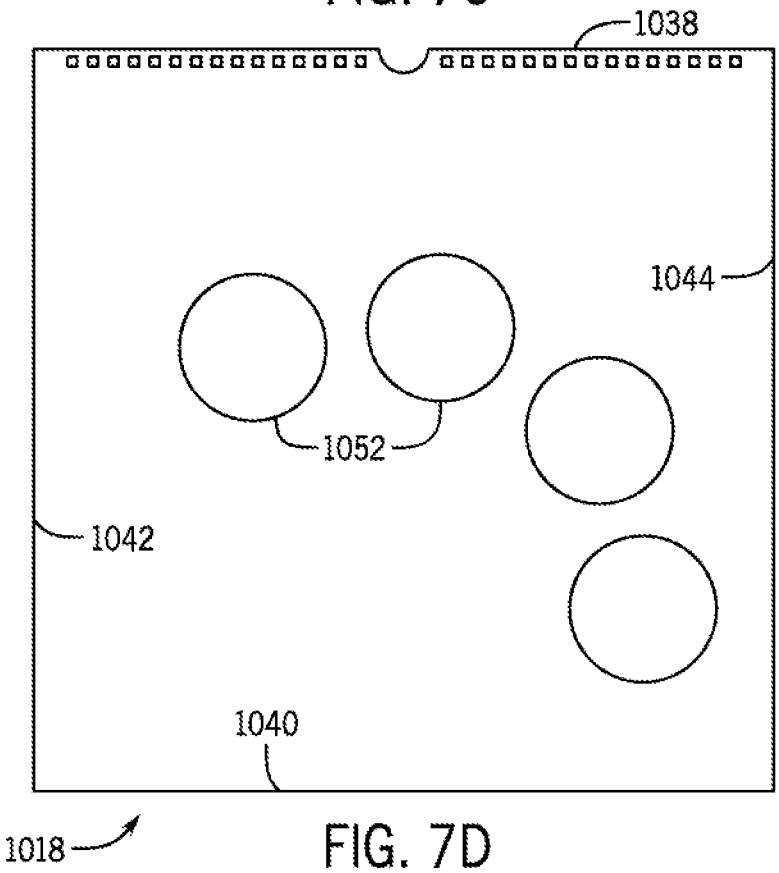
Figure 7E:
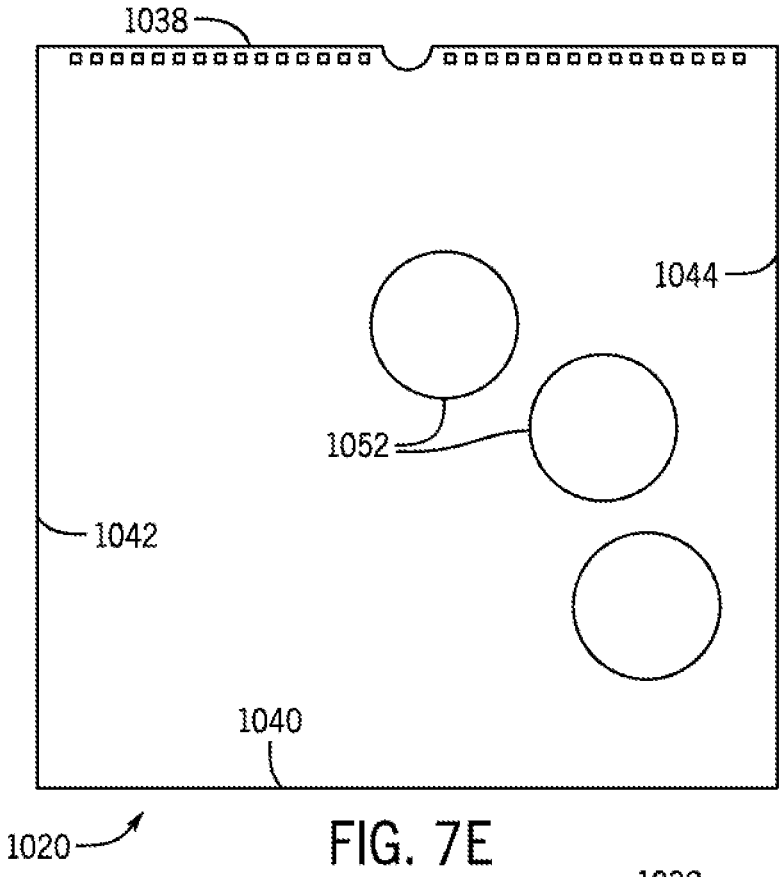
Figure 7F:
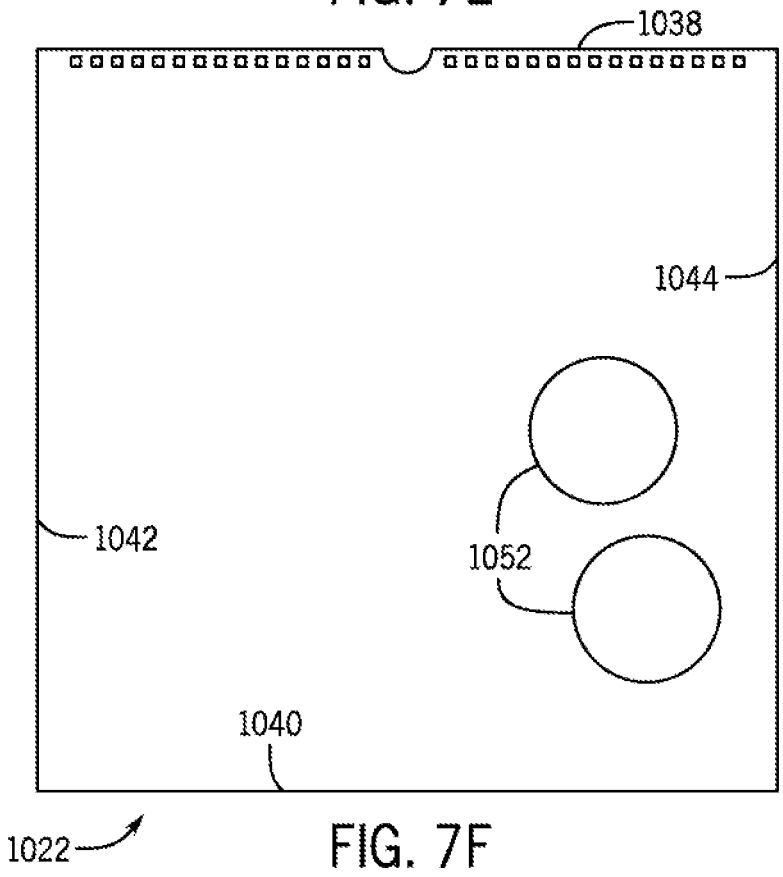
Figure 7G:
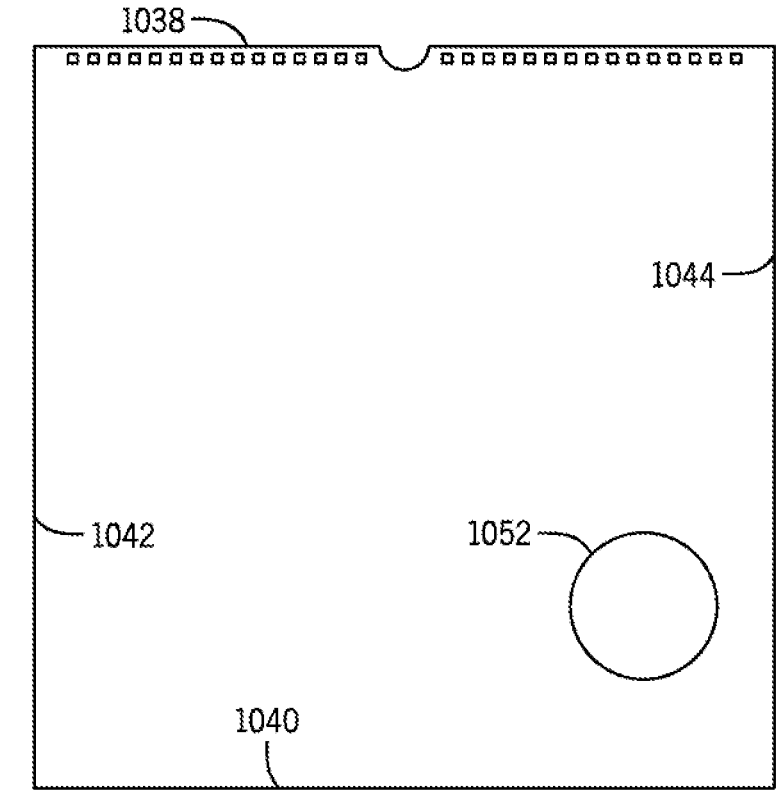
Figure 7H:
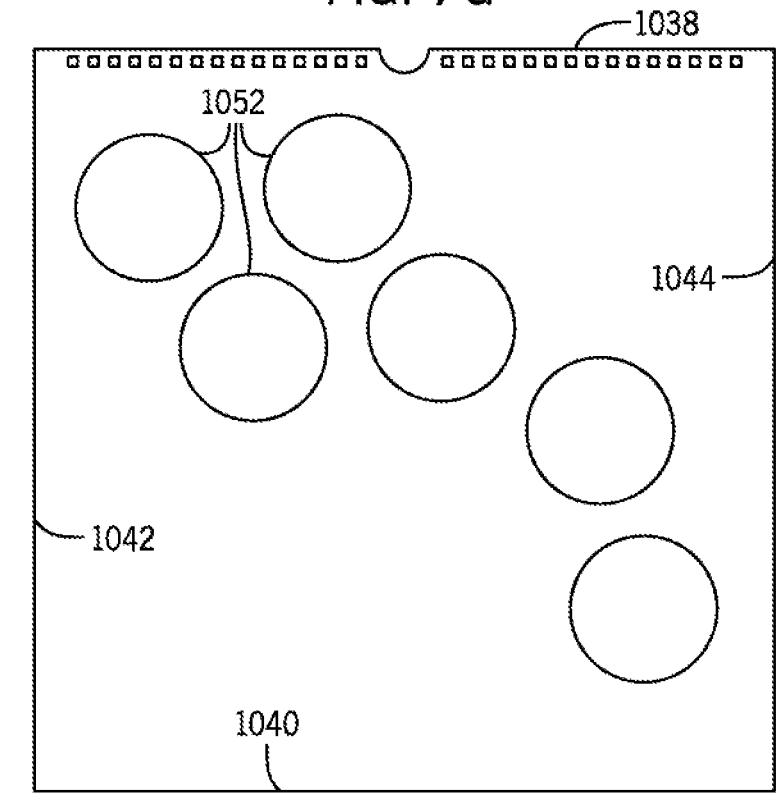
Figure 7I:
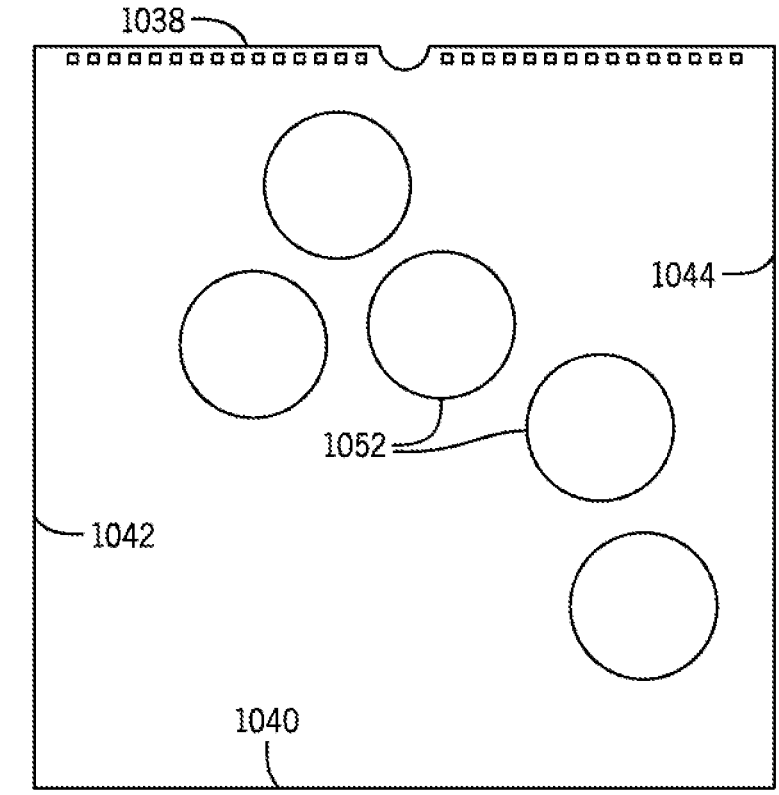
Figure 7J:
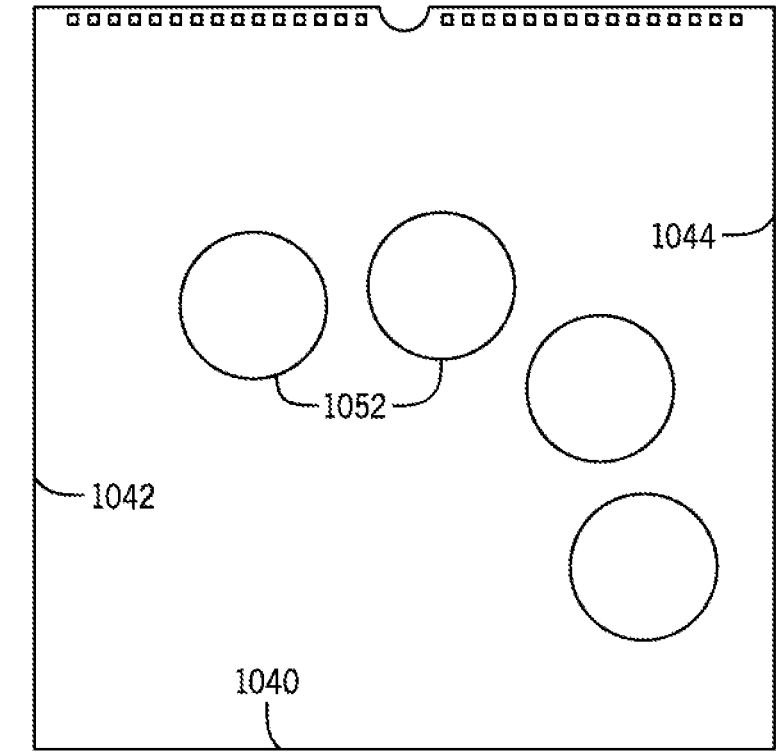
Figure 7K:
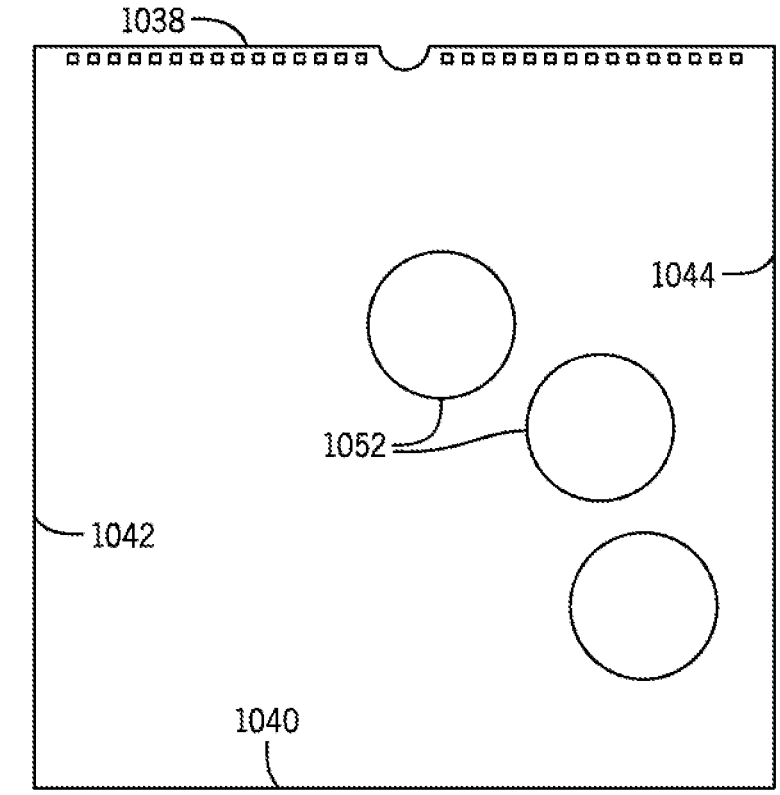
Figure 7L:
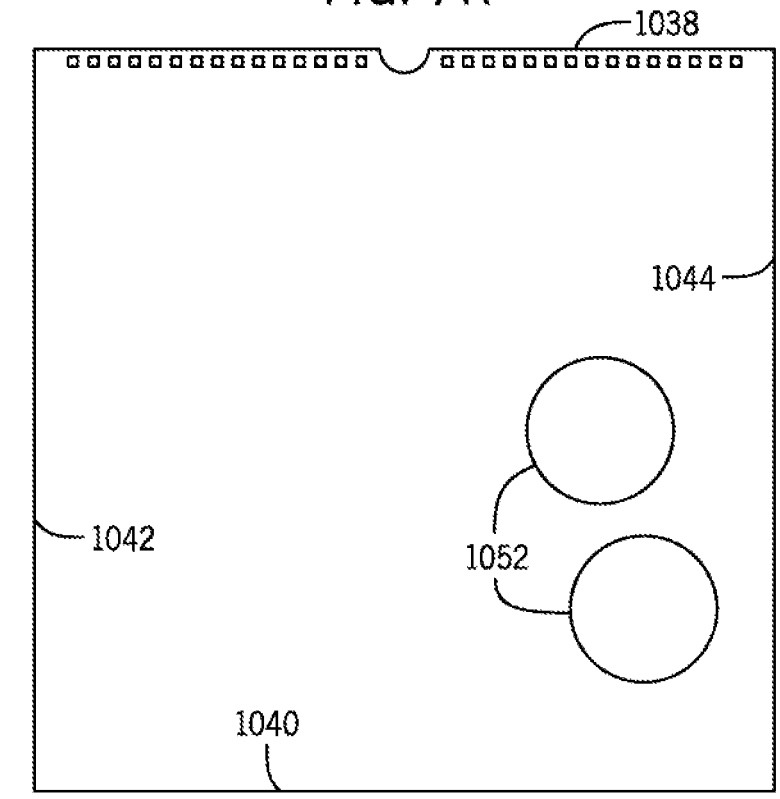
Figure 7M:
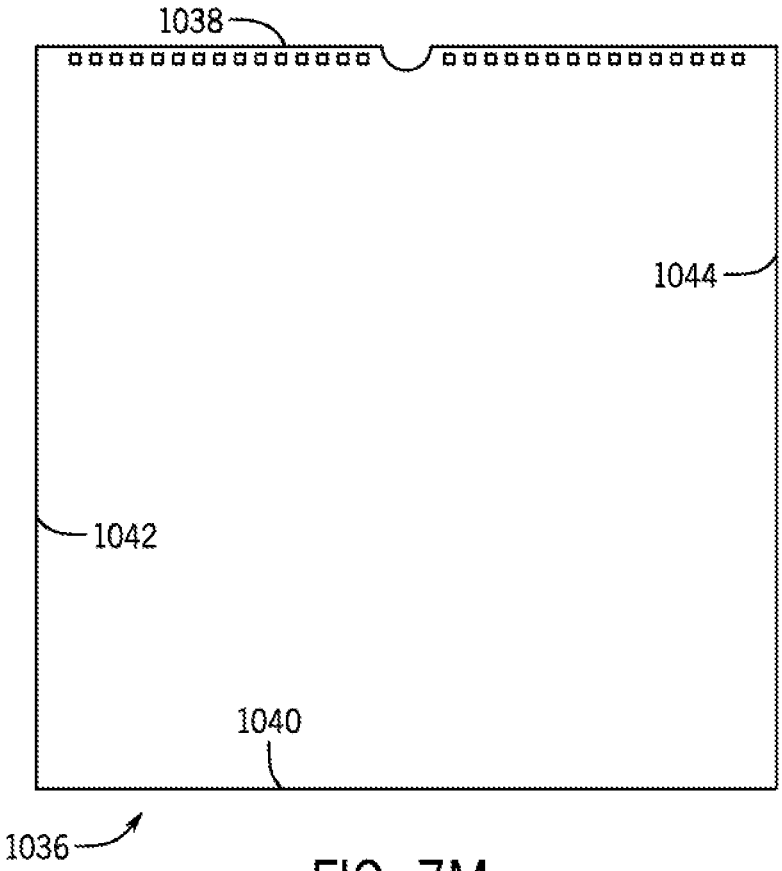

As shown in the exemplary embodiment of FIG. 4, the calendar 10' provides the stacked pages 12'-38' in the selected arrangement for the bottom edges 40' when displaying the selected page 12'-38' for the month, with the arrangement being able to be altered by moving the pages 12'-38' relative to one another using the securing device 46'.

In alternative embodiments, the pages 12'-36' can include the decorative edges 37', 40, 42' and/or 44' in any combination along with apertures 52, thrilled in the pages 12'-36'.

Looking now at FIGS. 5A-5M, another exemplary embodiment of a calendar 10" is illustrated. The pages 12"-36" of the calendar 10" are formed and secured to one another similarly to those of the prior embodiments of the calendar 10 and 10', but with varying designs for the bottom edges 40" that do not align or correspond particularly to the bottom edges 40" of other pages 12"-36" m order to provide a different aesthetic appearance to the calendar 10".

Referring now to FIGS. 6A-6M, another exemplary embodiment of a calendar 100 is illustrated. The pages 112-136 of the calendar 100 are thrilled and secured to one another similarly to those of the prior embodiments of the calendar 10, 10' and 10", but with varying designs for the bottom edges 140 and side edges 142, 144 that do not align or correspond particularly to the corresponding edges 140, 142, 144 of other pages 112-136 in order to provide a different aesthetic appearance to the calendar 100 depending upon the page 112-136 located on the front of the calendar 100. As such, certain pages, e.g., 112 have a width less than that of others. e.g., 116, but with one side edge 142,144 of the narrow page 112 corresponding to the same side edge 142,144 of the wider page 116 to allow portions of the wider page 116 to be viewed beneath and/or around the narrow page 112, and to enable portions of other wide pages, e.g., page 118, to be viewed beneath and/or around both the narrow page 112 and the wide page 116.

Referring now to FIGS. 7A-7M, another exemplary embodiment of a calendar 1000 is illustrated. The pages 1012-1036 of the calendar 1000 are formed with edges 1038-1044 and secured to one another similarly to those of the prior embodiments of the calendar 10, 10', 10" and 100, but with varying designs for apertures 1052 in each of the pages 1012-1036 that partially align or correspond particularly to the apertures 1052 located in other pages 1012-1036 in order to provide a different aesthetic appearance to the calendar 100 depending upon the page 1012-1036 located on the front of the calendar 1000. The apertures 1052 in each page 1012-1036 are aligned with one another, but the number of apertures 1052 in a page 1012-1036 can increase or decrease relative to the preceding and; or following pages 1012-1036, providing varying amounts of viewing of the indicia present on the underlying pages 1012-1036.

Further, in any of the preceding embodiments, the page 1036 including no varying edges 1038-1044 or apertures 1052 can be constructed of a material different from the remaining pages 1012-1034, in order for the page 1036 to function as a backing for the calendar 1000, such as for mounting the calendar 1000 to an appropriate mounting surface (not shown). Also, the variations present in the edges 1040-1044 and or apertures 1052 (if present) in any of the preceding embodiments can be used alone or in combination with one another within the scope of this disclosure.

Additionally, in any of the previous embodiments, a cover (not shown) can be positioned over the first page 1012, in order to obscure the imaging/indicia on the pages 1012-1036 until the cover is removed from the calendar 1000 or when the calendar 1000 is removed from any packaging (not shown) including the calendar 1000 and the cover.

Various other alternatives are contemplated as being within the scope of the following claims particularly pointing out and distinctly claiming the subject matter regarded as the invention.

We claim:

1. A calendar comprising a number of pages wherein each page below a top page includes printed indicia disposed on an exposed area of each page that can be selectively viewed around a peripheral edge of an adjacent page, and wherein the peripheral edge of each of the number of pages has at least two side edges that are distinct from an immediately preceding adjacent page and an immediately following adjacent page.

2. The calendar of claim 1 wherein the exposed areas are aligned with at least one side edge of the immediately preceding adjacent page and an immediately following adjacent page.

3. The calendar of claim 2 wherein the exposed areas are formed on multiple edges of the pages.

4. A method for presenting a coordinated decorative appearance for a calendar, the method comprising the steps of:

a. providing a calendar including a number of pages wherein each page includes printed indicia disposed on an exposed area of each page that can be selectively viewed below a peripheral edge of an adjacent page; and b. selectively positioning the pages to enable selected exposed areas to be viewable around adjacent pages.

5. The method of claim 4, wherein the exposed areas are aligned with at least one side edge of adjacent pages.

* * * * *